US010724829B1

(12) United States Patent
Ding et al.

(10) Patent No.: US 10,724,829 B1
(45) Date of Patent: Jul. 28, 2020

(54) TOOLLESS ZERO SYSTEMS FOR AN OPTICAL DEVICE

(71) Applicant: Leapers, Inc., Livonia, MI (US)

(72) Inventors: Tai-lai Ding, Northville, MI (US); Tat Shing Yu, Plymouth, MI (US)

(73) Assignee: Leapers, Inc., Livonia, MI (US)

( * ) Notice: Subject to any disclaimer, the term of this patent is extended or adjusted under 35 U.S.C. 154(b) by 0 days.

(21) Appl. No.: 16/289,237

(22) Filed: Feb. 28, 2019

(51) Int. Cl.
*F41G 1/54* (2006.01)
*F41G 1/38* (2006.01)

(52) U.S. Cl.
CPC ..... *F41G 1/545* (2013.01); *F41G 1/38* (2013.01)

(58) Field of Classification Search
CPC ..... F41G 1/545; F41G 1/38
USPC ..... 42/122
See application file for complete search history.

(56) References Cited

U.S. PATENT DOCUMENTS 8,006,429 B2 * 8/2011 Windauer ..... F41G 1/38 42/119
8,312,667 B2 * 11/2012 Thomas ..... F41G 1/18 42/122
8,490,317 B2 * 7/2013 Adkins ..... F41G 1/38 42/135
8,516,736 B2 * 8/2013 Windauer ..... F41G 1/38 42/119
8,806,798 B2 * 8/2014 Crispin ..... F41G 1/38 42/119
8,904,696 B2 * 12/2014 Geller ..... F41G 1/38 356/252
9,062,934 B1 * 6/2015 Presley ..... F41G 1/38
10,012,476 B2 * 7/2018 Ottl ..... F41G 1/38
10,190,848 B2 * 1/2019 VanBecelaere ..... F41G 1/38
10,234,239 B1 * 3/2019 Webber ..... G05G 5/06
10,302,394 B2 * 5/2019 Ding ..... G02B 27/36
2017/0199009 A1 * 7/2017 Ding ..... G02B 27/36

* cited by examiner

*Primary Examiner* — Samir Abdosh
(74) *Attorney, Agent, or Firm* — Warner Norcross + Judd, LLP

(57) ABSTRACT

An optical device includes a toolless rezero system and/or a zero locking system. The rezero system can operate in a first mode in which a scale ring is non-rotatable relative to an axis. The ring can be manually moved to a second mode, where the ring is rotatable relative to the axis, so alphanumeric characters and bars can be moved about the axis to align a preselected zero element with a reference element and rezero the device. The zero locking system can include a locking cover button that is manually movable to automatically operate a locking ring in a first mode in which it rotatably couples the dial with an adjusting pin to move a reticle, and in a second mode in which it couples the adjustment dial to an immovable wheelbase so the dial is non-rotatable, and the reticle is locked in position. Related methods are provided.

20 Claims, 15 Drawing Sheets

TOOLLESS ZERO SYSTEMS FOR AN OPTICAL DEVICE

BACKGROUND OF THE INVENTION

The present invention relates to aiming devices, and more particularly to optical scopes having a tool-less rezero system and/or a zero locking system.

The popularity of target shooting and other dynamic shooting sports has increased over the past several decades. The competitive nature of shooting and the desire to have well placed shots has led to the development and commercialization of a variety of aiming devices. A popular aiming device for short, medium and long range shooting is the optical scope.

Optical scopes are usually used on firearms, such as rifles, shotguns and handguns to aid the user in aiming at and precisely engaging a target when firing the firearm. A scope is typically mounted atop the firearm in a location above, and longitudinally aligned with, a barrel of the firearm. The scope, via its reticle, defines an aiming point coincident with the point of impact of a projectile, such as a bullet, on a target. The reticle can be in the form of a cross-hair, dot, post or other type of sight element. A number of optical lenses are also present in the scope tube to aid in viewing the target and in some cases magnifying the target.

Before using a firearm having an optical scope attached thereto, a careful user will sight in or "zero" the scope. That is, the user will adjust the vertical and horizontal position of the reticle, as viewed through the scope, to compensate for elevational and side-to-side misalignment of the scope with regard to the firearm barrel, distance to the target, ballistic characteristics of ammunition and other factors. This is accomplished by adjusting the elevation, or vertical position, and windage, or horizontal position, of the reticle.

Most optical scopes include windage and elevation adjustment knobs. These knobs are rotatably mounted to the scope tube and mechanically connected to the reticle. By rotating a knob, a user can move the reticle in a desired direction (typically up/down and left/right) to set the reticle in a predetermined configuration corresponding to a desired point of impact of a bullet shot from the firearm. Again, this process is called sighting in or zeroing the scope or firearm.

Some scopes are outfitted with adjustment knobs that remain rotatable in all conditions, that is, when the knob is being used to adjust the reticle, and even after the adjustment is fully completed. An issue with such always-adjustable knobs is that if the knob is inadvertently bumped in the field or transit, the reticle will also move, causing a misalignment thereof with a desired point of impact. In other words, the scope will no longer be properly zeroed or sighted in. To address this issue, some scope manufacturers offer the scope with scope knob caps that cover the knobs so they cannot be inadvertently rotated. These covers, however can be inadvertently lost, and take time to install and remove.

Other scope manufacturers include a threaded locking ring that physically locks the knob in a fixed rotational position after adjustments have been made to set the reticle. A well-known and popular scope with such zero locking capability is the Accushot® UTG 3×12×44 mm Scope, available from Leapers, Inc. of Livonia, Mich. This type of locking ring is disclosed in U.S. Published Patent Application 2017/0199009 to Ding, which is hereby incorporated by reference in its entirety. While this type of zero lock is durable and easy to use, it still can require the use of tools in some applications.

Some scopes can include a removable zero cap. This cap can include the number zero and subsequent numbers and bars, equally spaced from one another. The zero and its bar typically are aligned with a reference bar on the base of the knob fixed to the scope to indicate to the user that the adjustment knob has not been moved relative to a sight in the scope. The removable zero cap can be attached to the remainder of the knob with a screw. After a user sights in the scope, many times, the zero bar is not aligned with the reference bar on the base because the knob and cap were rotated to sight in the scope. Thus, to "rezero" the knob, the user can remove the screw with a tool, remove the cap, then rotate the cap and set it back on the remainder of the knob with the zero bar aligned again with the reference bar. The user can then tighten the screw with a tool to secure the zero cap in this orientation, thereby rezeroing the adjustment knob. While this type of removable zero cap is easy to use, it requires the use of tools and can be prone to being dropped, lost or contaminated with dust and debris, which can impair operation of the adjustment knob.

Accordingly, there remains room for improvement in scopes, and in particular, the zeroing and locking features of adjustment knobs used in conjunction with scopes.

SUMMARY OF THE INVENTION

An optical device including one or more toolless zero systems for rezeroing the device and/or locking the zero of the device is provided.

In one embodiment, the toolless rezero system can include an adjustment dial, an axis, and a scale ring protruding below the dial to expose a scale of alphanumeric characters and/or bars. In a first mode, the scale ring is non-rotatable relative to the axis. In a second mode, the scale ring is rotatable relative to the axis, so the characters and bars can be moved about the axis to align a preselected zero numeral and bar with a reference element to thereby rezero the optical device.

In another embodiment, the scale ring can include an upper portion and a lower portion. The upper portion can be located inside a dial interior of the dial. The lower portion can protrude below the lower dial edge and can be visible. The lower portion can include multiple alphanumeric characters and the bars. The upper portion also can include one or more scale teeth selectively engagable with one or more holding teeth in the dial interior.

In still another embodiment, the rezero system and/or scale ring are operable in a first mode in which the scale teeth engage holding teeth such that the scale ring is not rotatable relative to the axis. In a second mode, the scale teeth are disengaged from the holding teeth such that the scale ring is free to rotate about the axis, while the dial optionally remains nonrotating relative to the axis. To transition from the first mode to the second mode, a user can vertically move the scale ring to disengage the teeth without the use of tools, then rotate the scale ring to attain proper alignment of the characters and/or bars and thereby zero the optical device. Usually, this will include aligning the zero numeral and its bar with another reference element fixed on a base of the optical device.

In yet another embodiment, the toolless rezero system can include a scale ring bias element engaging the scale ring in the dial interior. The bias element can urge the scale ring into the first mode to maintain the scale teeth in engagement with the holding teeth. The scale ring bias element can be coil spring disposed in the dial interior, hidden from view, and disposed about the axis. The coil spring can engage the upper portion of the scale ring.

In even another embodiment, the holding teeth can be disposed on an annular support ring that is positioned around the axis. The support ring can include a toothless area adjacent the plurality of holding teeth. In the second mode, the scale teeth are aligned with the toothless area, so that the scale teeth can move relative to the annular support ring, thereby allowing the scale ring and its characters to move about the axis for alignment with a reference bar.

In a further embodiment, a method of using the toolless rezero system is provided. The method can include: moving the scale ring vertically in a first direction relative to the adjustment dial to thereby permit rotation of the scale ring about an axis; rotating the scale ring about the axis to align a preselected indicia element with a reference element on the optical device, while the adjustment dial remains in a fixed rotational configuration relative to the axis; and moving the scale ring vertically in a second direction, opposite the first direction, such that the scale ring becomes non-rotatable relative to the adjustment dial, with the preselected indicia element remaining aligned with the reference element to thereby rezero the optical device.

In still a further embodiment, the method of using the toolless rezero system can be such that during the moving in the first direction, a lower scale ring edge can move away from and/or toward a lower dial edge of the adjustment dial. During the moving in the second direction, the lower scale ring edge can move in the opposite direction away from and/or toward the lower dial edge.

In yet a further embodiment, the method of using the toolless rezero system can be such that the moving the scale ring vertically in the first direction can disengage an annular arrangement of scale teeth from an annular arrangement of holding teeth, so that the scale ring is permitted to rotate relative to a support ring. During the moving the scale ring vertically in the first direction, the scale ring can move upward into the dial interior a predetermined amount sufficient to allow the plurality of indicia elements to remain visible to a user below a lower dial edge.

In another, further embodiment, the zero locking system can include the dial, a locking cover button, a locking ring and a wheelbase. The locking cover button can be manually movable, without the use of tools, to operate a locking ring in a first mode in which the locking ring rotatably couples the dial with an adjusting pin to move a reticle, and in a second mode in which the locking ring couples the adjustment dial to the immovable wheelbase so the dial is non-rotatable, and the reticle is locked in a position.

In still another embodiment, the zero locking system can include an adjusting pin adjacent the wheelbase and rotatable about the axis. The adjusting pin can join with a reticle for relative movement of the reticle within a scope tube of the optical device.

In yet another embodiment, the zero locking system can include an adjusting switch. The adjusting switch can interface with the locking cover button to move the locking ring to and from the first mode and the second mode. The adjusting switch can include an adjusting gear and the locking cover button can include a corresponding adjusting gear. These gears can engage one another so as to impart rotation to the adjusting switch about the axis. Upon such rotation, the adjusting switch can move and translate motion to the locking ring to move the locking ring.

In even another embodiment, the zero locking system can be constructed so that the wheelbase includes a base holding element and the locking ring includes a ring locking element. The base holding element can be in the form of an arrangement of base teeth and the ring locking element can be in the form of an arrangement of locking teeth. In the first mode, the ring locking element can engage the base holding elements so the locking ring is non-rotatable relative to the wheelbase. In the second mode, the ring element can be disengaged from the base holding element such that the locking ring is rotatable relative to the wheelbase. Thus, in the second mode, the dial can be used to rotate the locking ring and the adjusting pin to move the reticle from a first position to a second, different position. For example, the reticle can be moved up and down, or side to side to adjust for elevation or yardage, depending on which turret is being adjusted.

In still a further embodiment, the zero locking system can include an adjusting switch including an actuator gear with different depth teeth. Corresponding actuator teeth associated with the locking ring cover can selectively engage the actuator gear and respective recesses to move the adjusting switch along the axis of the turret. The adjusting switch can generally be moved toward and away from the wheelbase. In turn, the adjusting switch can engage the locking ring to move it toward and away from the wheelbase, converting it from one mode to another.

In yet a further embodiment, the adjustment dial, locking cover button and adjusting switch can be interlocked with one another to rotate in unison in the second mode. The locking ring also can be interlocked with an adjusting base that is further nonrotatably coupled to the adjusting pin so that when the locking ring rotates with the other elements, it also can rotate the adjusting pin in the second mode.

In even another embodiment, the zero locking system can be incorporated into the same turret as the rezeroing system. The locking ring and/or the adjusting switch can be disposed in the interior of the adjustment dial, and located radially inward toward the axis from the scale ring.

In a further embodiment, the locking cover button can be in the form of a manually depressible button that moves along a line of direction that is parallel to the axis of the turret. The button can be pushed to translate the locking ring from the first mode to the second mode and vice versa. This transition can occur automatically upon depression of the button.

In still a further embodiment, the zero locking system can be operated according to a method. The method can include providing the adjustment dial and the locking cover button; moving the locking cover button a first time, manually without the use of tools, to automatically convert a locking ring from a first mode in which the locking ring is non-rotatable relative to an axis to a second mode in which the locking ring is rotatable relative to the axis; rotating the adjustment dial and the locking ring in unison about the axis to move a reticle relative to a scope tube; and moving the locking cover button a second time, manually without the use of tools, to automatically convert the locking ring from the second mode to the first mode, such that the locking ring is non-rotatable relative to the axis, and such that the adjustment dial cannot be rotated to move the reticle relative to the scope tube, whereby the reticle is locked in a position relative to the scope tube.

The optical device of the current embodiments can provide a toolless rezero system and/or a toolless zero locking system that previously have been unachievable. Where the rezero system is included, a user can quickly and precisely reset a turret scale to zero without the use of tools and without disassembling the turret. In turn, the likelihood of misplacing, losing or damaging parts of the system is also reduced. Where the zero locking system is included, a user can lock a turret so that it cannot be rotated without the use of tools and without disassembling the turret. In turn, the reticle associated with the turret can be automatically locked in place without risk of it being moved via the dial being inadvertently rotated. Thus, the zero of the optical device can be easily and quickly set and automatically locked and unlocked.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

An optical device of a current embodiment is shown in FIGS. 1-6 and generally designated 1. The optical device 1 can be in the form of an optical scope as shown, but of course, it can be in the form of an electronic sighting system, a night vision or thermal scope, a camera, a spotting scope, or any type of optical or viewing system for use with a variety of other articles. Although shown in the form of a fixed objective, single power scope, the optical device 1 can be an adjustable objective scope and optionally can be of varying magnification. Various mechanisms, such as an adjustable objective and a magnification system can be included on the device 1 depending on the application.

The optical device 1 can be used with any type of projectile shooting device, such as a firearm. For example, the aiming device can be used with and mounted to a handgun, such as a pistol and/or a revolver; a rifle, such as a long rifle, a carbine, a bolt rifle, a pump rifle or a battle rifle; a shotgun and/or a machine gun, such as a machine pistol, a light machine gun, a mini gun, a medium machine gun or a heavy machine gun. The firearm can include any type of action, for example, bolt action, lever action, pump action and/or break action. The firearm can be single shot, automatic and/or semiautomatic.

Figure 1:
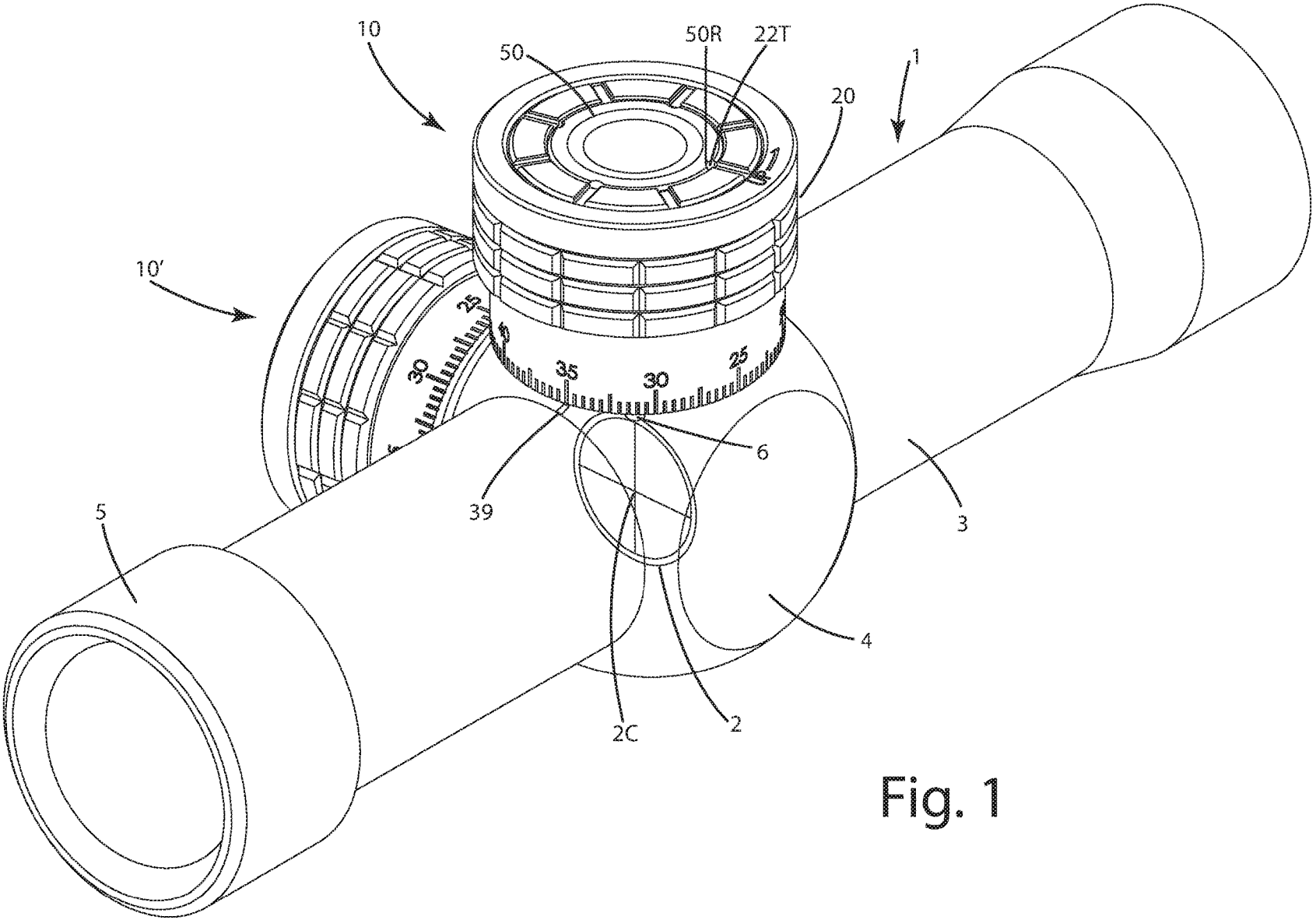
FIG. 1 is a perspective view of an optical device including a toolless zero mechanism of a current embodiment, with a toolless rezero system before rezeroing and a toolless zero locking system in a locked mode.

As illustrated in FIG. 1, the optical device 1 can include a reticle 2. The reticle can be fine cross hairs, but of course, the reticle can be in the form of a dot, chevron, pattern, or any other configuration. The reticle can be illuminated or not. The reticle 2 can be displayed inside the scope tube 3 when a user peers through the eyepiece 5 of the scope tube 1. The reticle 2 can be moved to adjust elevation and windage via manual manipulation of the respective adjustment turrets 10, 10' which are joined with the scope tube at the eye bell 4. These adjustment turrets can be similarly configured, and each can include a toolless rezero system and toolless zero locking system as described below. For the sake of simplicity, only the elevation turret 10 will be described here.

Figure 2:
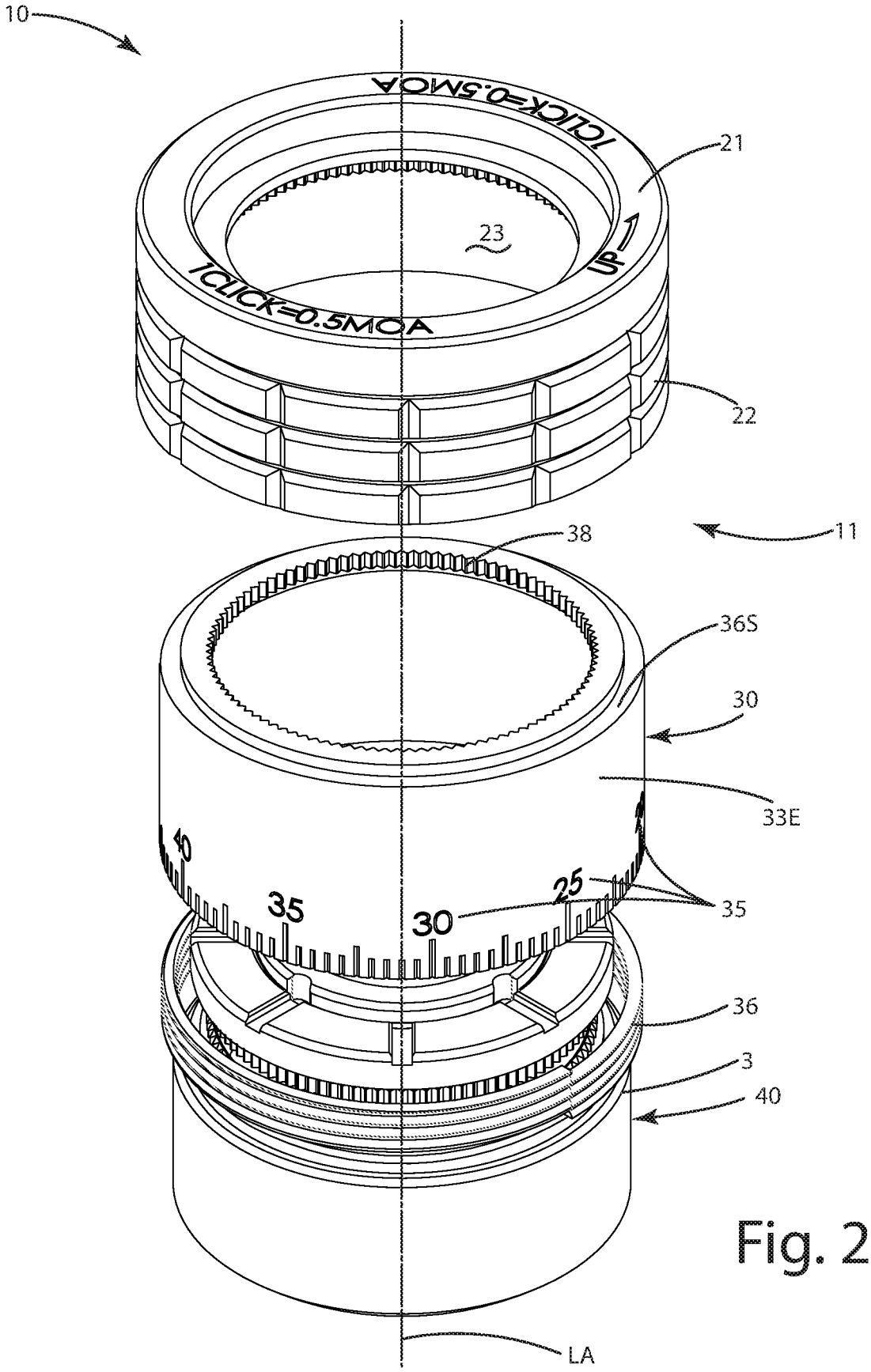
FIG. 2 is an exploded view of the rezero system of the mechanism.

With reference to FIG. 2, the optical device 1 includes the turret 10, with a toolless rezero system 11. The system 11 can include an adjustment dial 20 which can be manually grasped by a user to rotate portions of the turret, a scale ring 30 including multiple indicia elements 35, and a support ring 40 with which the scale ring 30 interacts. The dial 20, scale ring 30 and support ring 40 can all be disposed about and generally centered on a longitudinal axis LA of the turret 10.

The toolless rezero system 11 can be utilized by a user to reset the multiple indicia elements 35 relative to a reference element 39. This reference element 39 can be permanently and immovably associated with another portion of the optical device 1. For example, as shown, the reference element 39 can be in the form of a groove or recess that is included on the rear portion of the eye bell 4. This reference element 39 and can be colored, for example with a white, red or other paint, coating or material that is able to stand out visually. This reference element 39 can be centered atop the scope tube 3 and/or eye bell 4. The reference element can be in the form of a bar or dot as shown. The reference element can serve as a baseline for adjustments to the turret to thereby move the reticle 2, which is mechanically joined with the turret 10, to enable the user to alter the position of the reticle 2 and compensate for elevation. In turn, this can enable the user to properly align the reticle with a target and precisely and accurately hit the target.

The reference element 39 is configured to align with the various indicia elements 35 on the scale ring 30. These indicia elements on a scale ring can comprise multiple alphanumeric characters. As illustrated, these elements also can comprise a plurality of vertical bars which can be in the form of grooves, indents and/or recesses that are physically machined or otherwise formed in the outer exterior surface 33E of the scale ring 30. These indicia elements 35 can be evenly spaced about the circumference of the scale ring 32 to form a scale. The scale can be calibrated to allow a user to make calculated adjustments to the windage and elevation after a scope is sighted in. These adjustments can be made to compensate for a target at a different distance than that at which the optical device 1 is zeroed.

Figure 8:
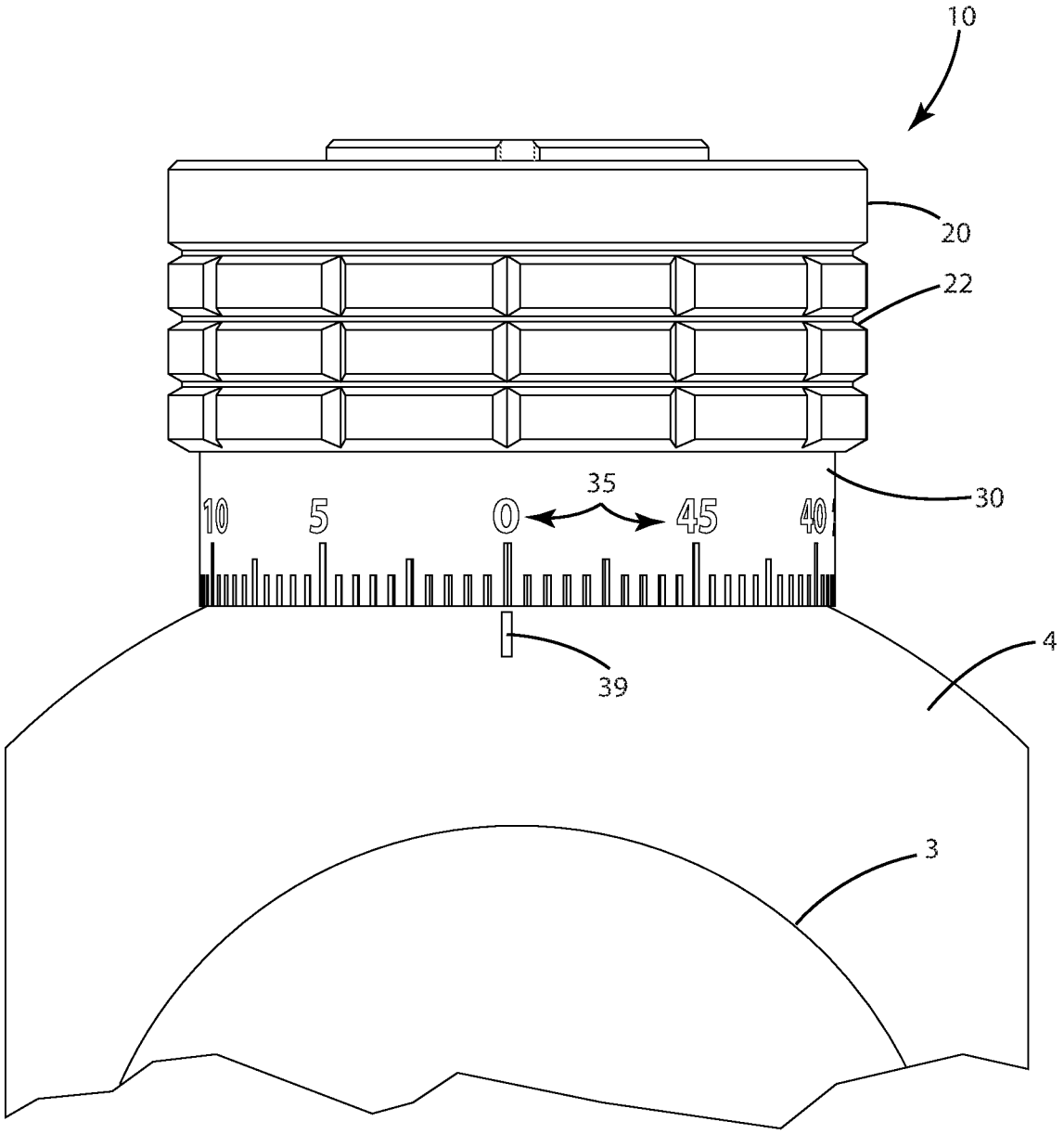
FIG. 8 is a rear view of the rezero system illustrating the adjustment turret of the mechanism after rezeroing relative to a reference element on a scope tube.
Figure 9:
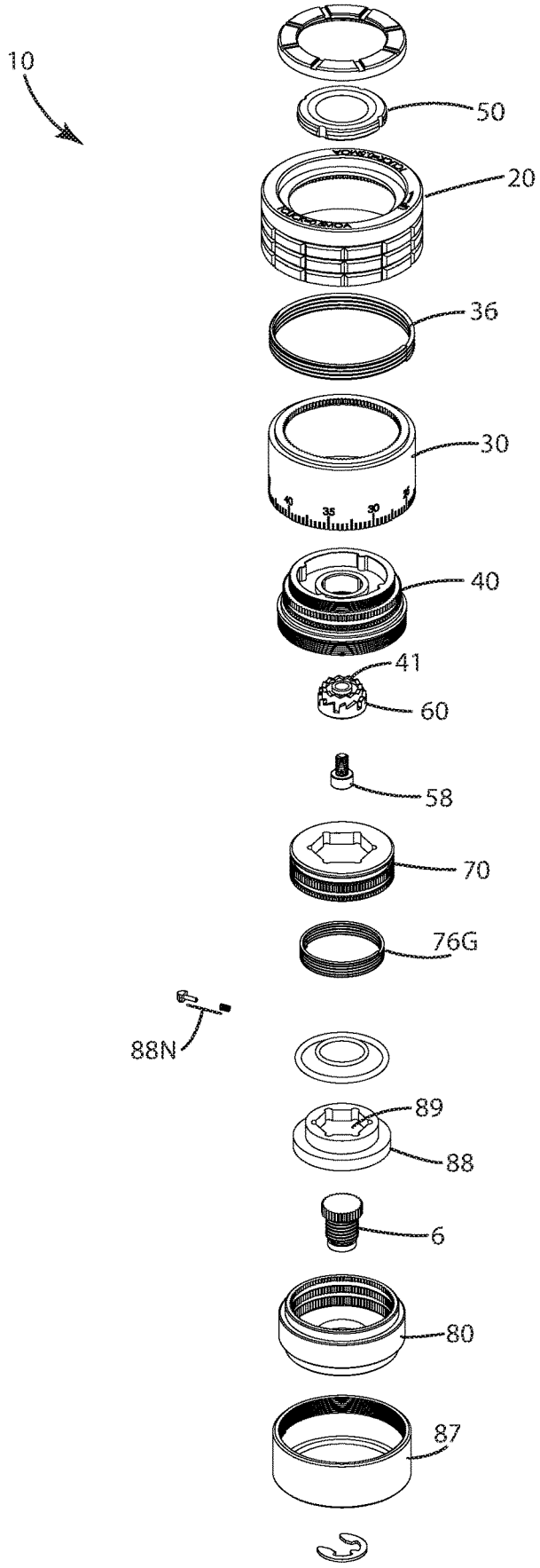
FIG. 9 is an exploded top perspective view of an adjustment turret of the mechanism.
Figure 10:
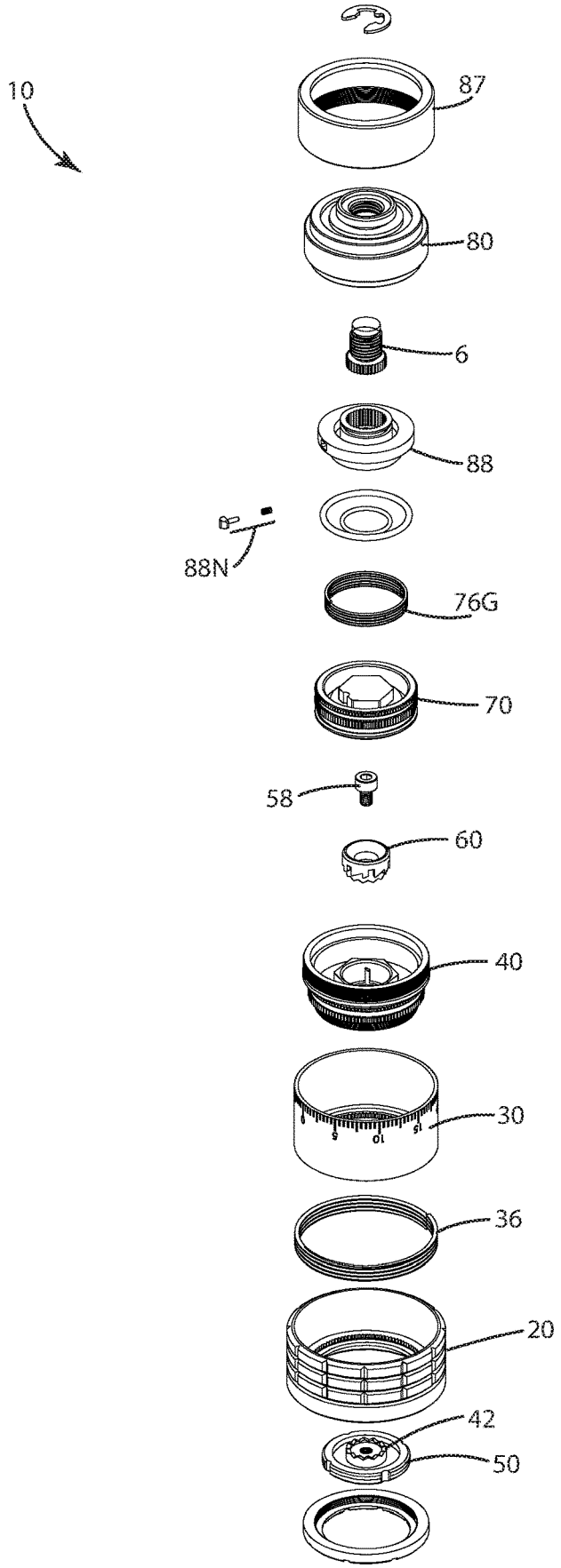
FIG. 10 is an exploded bottom perspective view of the adjustment turret of the mechanism.

As mentioned above, it is common to install an optical device 1 on a firearm and initially sight in that firearm. This process can require multiple iterative steps to move the reticle 2 and ensure that the center 2C of the reticle 2 coincides with the impact point of a projectile shot from the associated firearm. During the iterative process, many times, the elevation turret 10 and the windage turret 10' must be rotated to provide a corresponding movement of the reticle 2 within the eye bell 4 to properly align the center 2C with the point of impact. As the turrets 10 and 10' are rotated, the scale ring and associated indicia elements 35 rotate along with the dial 20. As a result, a random one of the indicia elements 35 can be aligned with the reference element 39. For example, when a scope is properly zeroed, the alphanumeric "0" and the associated bar can be aligned with the reference element 39, as shown in FIG. 8. When a user starts to rotate the adjustment dial 20, the scale ring 30 rotates with it such that the "0" which in some cases can be a preselected indicia element, becomes misaligned with the reference element 39. Accordingly, the scale ring and indicia elements, after a sight in of the optical device can look like the configuration shown in FIG. 3. There, a random indicia element 35, in the form of the alphanumeric "25," is aligned with the reference element 39. In this configuration, the scale ring does not offer the user a good, consistent reference orientation of the scale ring relative to the reference element 39. Thus, the user will want to reestablish the zero shown in FIG. 8 as described below.

Figure 3:
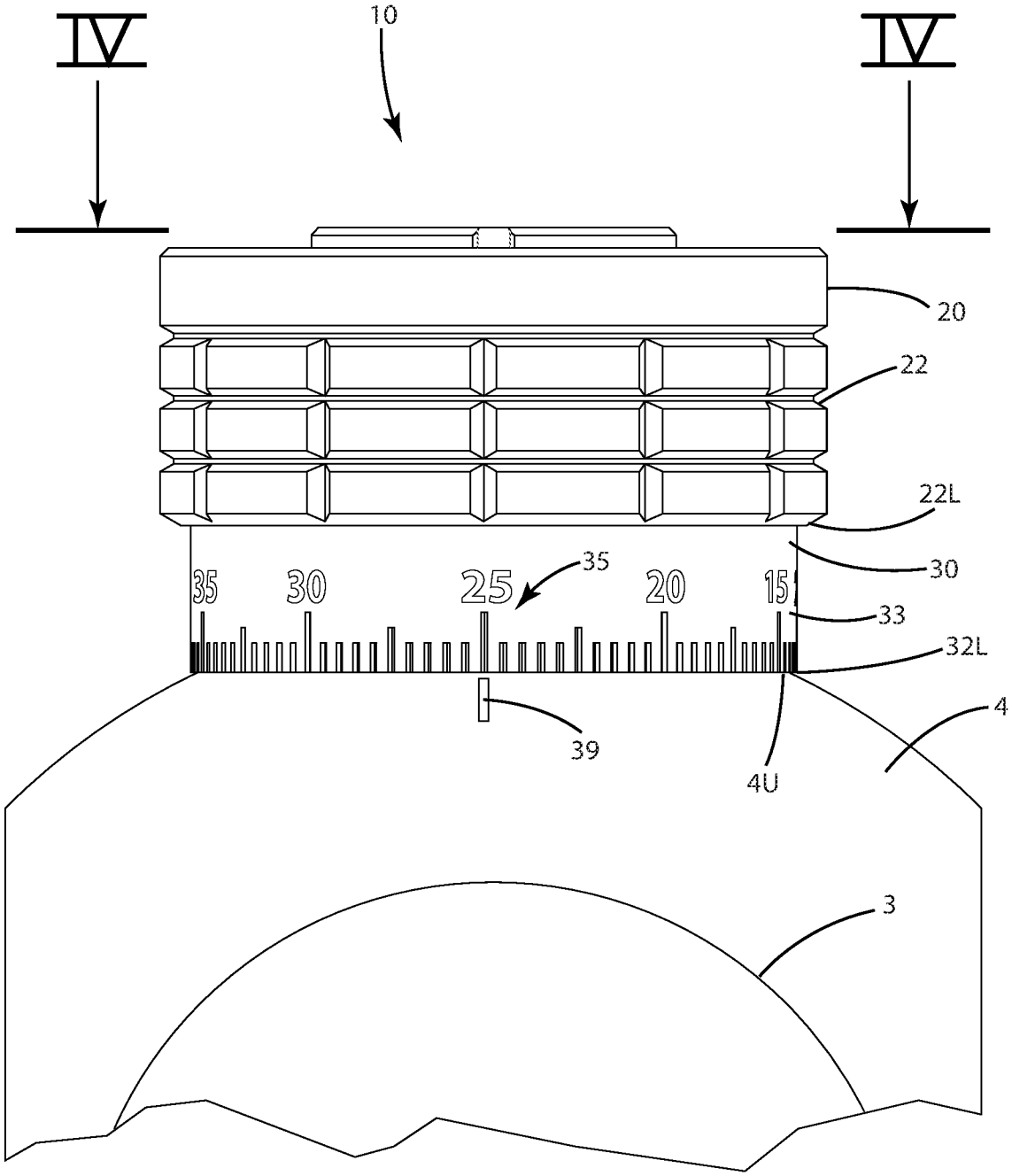
FIG. 3 is a rear view of the rezero system illustrating an adjustment turret of the mechanism before rezeroing relative to a reference element on a scope tube.
Figure 4:
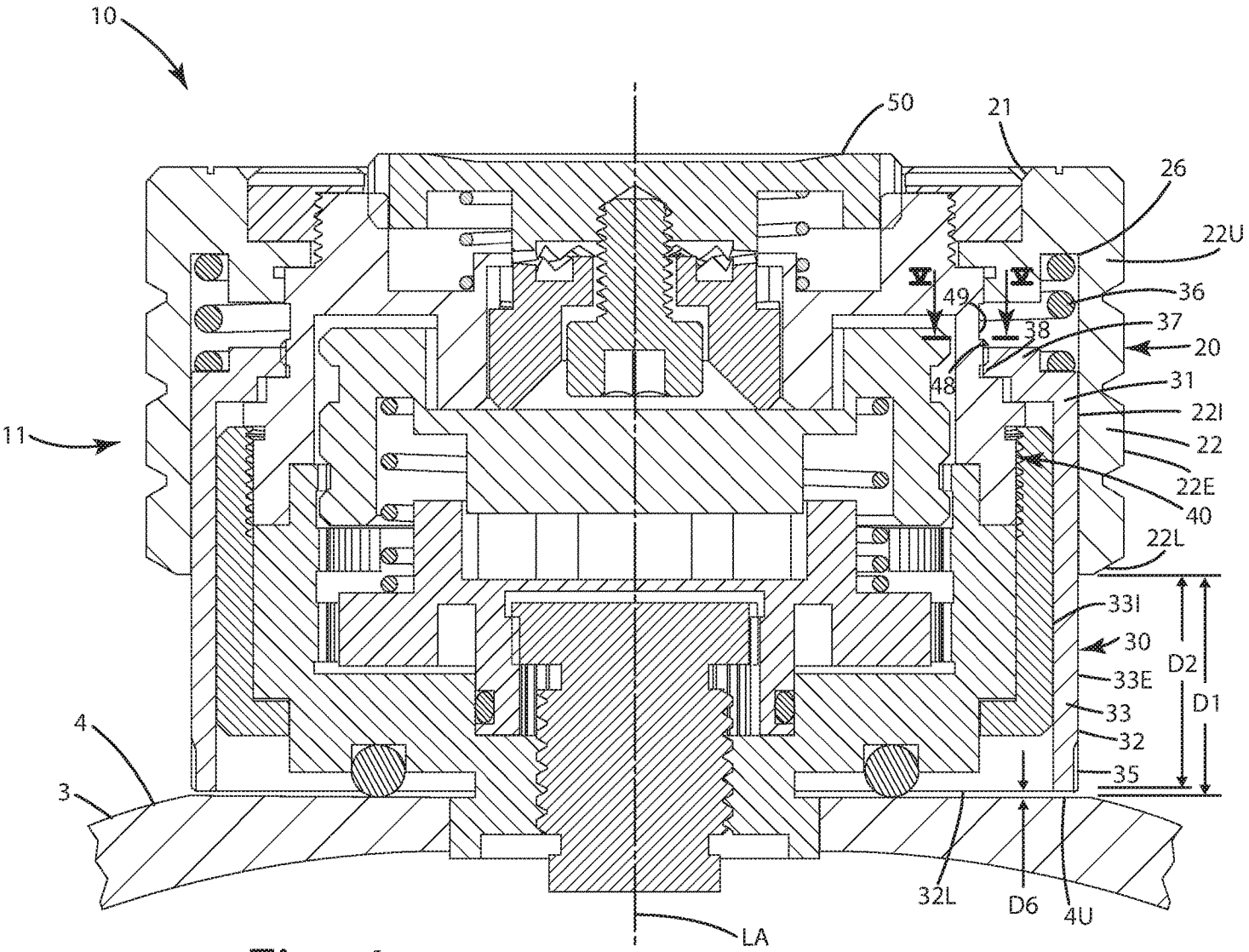
FIG. 4 is a section view of the adjustment turret taken along line IV-IV of FIG. 3, before rezeroing relative to a reference element, where a scale ring of the rezero system is in a first mode, generally immovable relative to a dial and axis of the turret.

Returning to the components of the toolless rezero system, as shown in FIGS. 2-4, the system 11 can include the dial 20, scale ring 30 and support ring 40. Each of these components will now be described in further detail. The adjustment dial 20 can be of a hollow cylindrical shape. The dial can be configured to be grasped by a user and turned or rotated about the longitudinal axis LA of the turret 10. As described further below, the adjustment dial 20 can form a portion of a zero locking system, which also includes a locking cover or button 50 as described further below. The adjustment dial 20 can include a top 21 and a downwardly extending dial wall 22. The downwardly extending dial wall 22 can include an interior surface 221 and an exterior surface 22E. The exterior surface 22B can include elements for gripping, such as knurls, threads, buttons, projections, depressions, ridges or the like. The interior surface 221 can be cylindrical and can face toward the longitudinal axis LA. The interior wall 221 can early bound a dial interior 23 as shown in FIG. 2. The dial wall 22 can include an upper portion 22U and a lower edge 22L. The lower dial edge 22L can be configured to remain at a fixed distance D1 from an upper surface 4U of the eye bell of the optical device 1. It can remain at this distance D1 throughout manipulation of the rezeroing of the system.

As shown in FIG. 4, the system 11 can include a scale ring bias element 36. The scale ring bias element 36 can be in the form of a coil spring. The spring can extend around the longitudinal axis LA and can be centered upon that longitudinal axis LA. The bias element can take on other configurations. For example, it can be an elastomeric element, a leaf spring, a magnetic biasing element, including magnets or some other biasing construction. The bias element optionally can be nestled in a spring groove 26 defined by the top 21 of the adjustment dial 20. Of course, the bias element 36 can be in other configurations and not located in a groove. The lower portion or lower coils 36L of the scale ring bias element 36 engage the scale ring 30 in particular a shoulder 36S of the scale ring. The engagement between the scale ring bias element 36 in this shoulder 36S can be continuous throughout operation of the rezeroing system 11.

Figure 5:
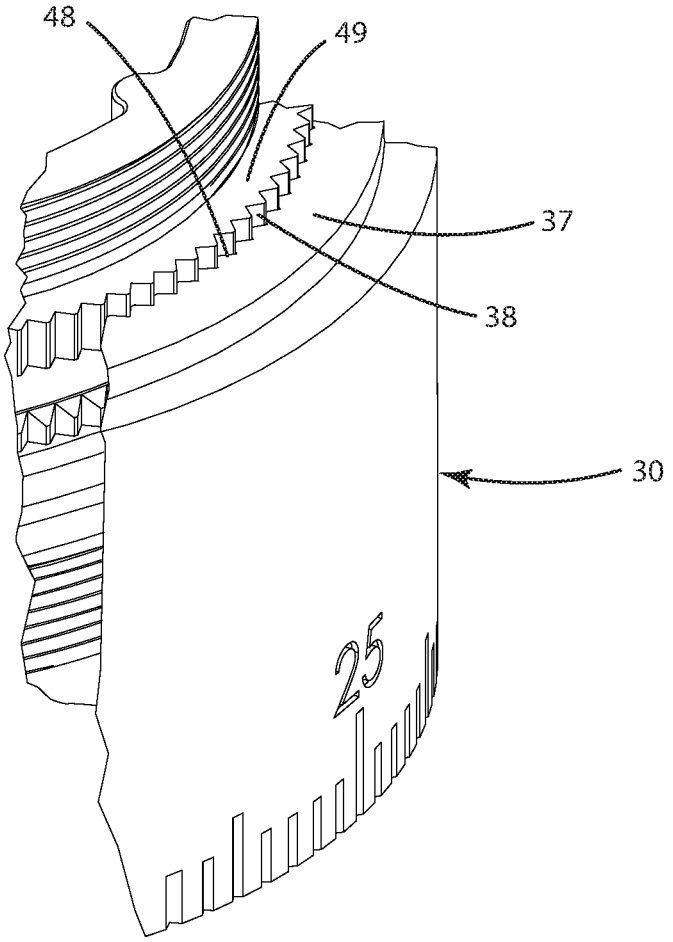
FIG. 5 is a close up view of scale teeth of the scale ring interlocking with holding teeth of a support ring to prevent rotation of the scale ring about the axis of the turret.

The scale ring 30 shown in FIGS. 2, 4 and 5 can include a scale wall 33 that extends from an upper portion 31 to a lower portion 32 of the scale ring. The lower portion 32 can terminate at a lower scale edge 32L. Adjacent this lower scale edge 32L, the reference indicia 35 can be disposed. These reference indicia elements as shown can include multiple grooves, indents or recesses (all referred to as grooves) extending upward from or adjacent the lower scale ring edge 32L. The reference indicia elements can be located in the lower portion 32 such that the reference indicia elements remain exposed below the dial lower edge 22L throughout use of an adjustment of the rezero system 11. In some cases, portions of the markings or the reference indicia elements 35 can be slightly obscured by the dial wall 22. The upper portion 31 of the scale ring 30 can be at least partially obscured or concealed by the dial wall 22. The scale wall 33 can include an exterior 33E and an interior 331. The exterior 33E in the upper portion 31 can be placed immediately adjacent the interior 221 of the dial wall 22. These two surfaces can be slidably engaged relative to one another when the scale ring 30 rotates and/or moves vertically relative to the dial 20 as described below.

The lower scale ring edge 32L is shown as being located at distance D2 below the lower dial edge 22L. This distance D2 is less than the distance D1 mentioned above. This distance D2 shown in FIG. 4 also is the distance between the lower dial edge 22L and the lower scale ring edge 32L, when the scale ring and/or the system 11 in general is in a first mode, which also can be a referred to as a scale ring locked mode which will be described further below.

The scale ring 30 as can include a shoulder 36S which engages the spring 36. The shoulder 36S can be located atop the upper portion 31 of the scale ring wall 33. The scale ring wall 33 also can include a flange 37 extending radially inward from the scale ring wall 33 toward the axis LA. This flange 37 can be adjacent the shoulder 36S and can be configured such that a portion of the spring 36 lays between the flange 37 and the interior wall 221 of the dial wall 22. The flange 37 can include an inner edge that includes one or more locking elements 38. As shown, those one or more locking elements 38 can be in the form of an arrangement of one or more scale teeth, which can be also referred to as a plurality of scale teeth. The inner edge of the flange can face toward the axis LA. The scale teeth can extend continuously around the axis LA as shown. In other cases, the teeth can be intermittently or non-continuously disposed around the axis. In other applications the teeth can be located on other parts of the scale ring, for example directly on the wall 33 itself.

As shown in FIGS. 4-5, the scale teeth 38 can be configured to selectively engage one or more holding elements 48. As shown, those one or more holding elements 48 can be in the form of an arrangement of one or more holding teeth disposed in the dial interior 23. These holding teeth 48, which can be referred to as a plurality of holding teeth, can be disposed on a variety of different components inside the interior, generally associated with the turret. As shown however, these teeth can be protruding from a support ring 40, also referred to as an adjusting cover, that is disposed inwardly from the scale ring and the dial wall 22. These holding teeth 48 can selectively engage the scale teeth 38 depending on whether the scale ring and system is in a first mode or a second mode as described below. Although the teeth are shown as triangular elements, they can take on other geometric configurations. The holding teeth and scale teeth can be configured to slide and/or move vertically upward and downwardly, in a direction parallel to axis LA, relative to one another so they can be engaged and disengaged from one another.

The holding teeth 48 can be disposed adjacent a featureless area 49, optionally where there are no teeth or other elements that can directly engage the scale ring teeth 38. This toothless area can be above and/or adjacent the holding teeth 48. As described further below, the scale teeth 38 can be moved and selectively aligned with the toothless area, so that the scale teeth can move and rotate relative to the annular support ring 40 adjacent the toothless area 49.

Operation of the tool as rezero system 11 will now be described with reference to FIGS. 1-8. As mentioned above, during adjustment of the optical device via the turret 10, the reference indicia elements 35 can become improperly aligned with the reference element 39. This misalignment is shown in FIG. 3. The user will work to realign the reference number "0", which can be a preselected indicia element, with the reference element 39, as shown in FIG. 8. As illustrated in FIGS. 3 and 4, the scale ring 30 and rezero system 11 are in a first mode. In this first mode, the scale teeth 38 associated with the scale ring 30 engage the holding teeth 48 in the interior 23. Due to this interaction and interfacing of the respective teeth, the scale ring is non-rotatable relative to the axis LA. The scale ring also can be generally non-rotatable relative to the support ring 40 and/or the dial 20.

Figure 6:
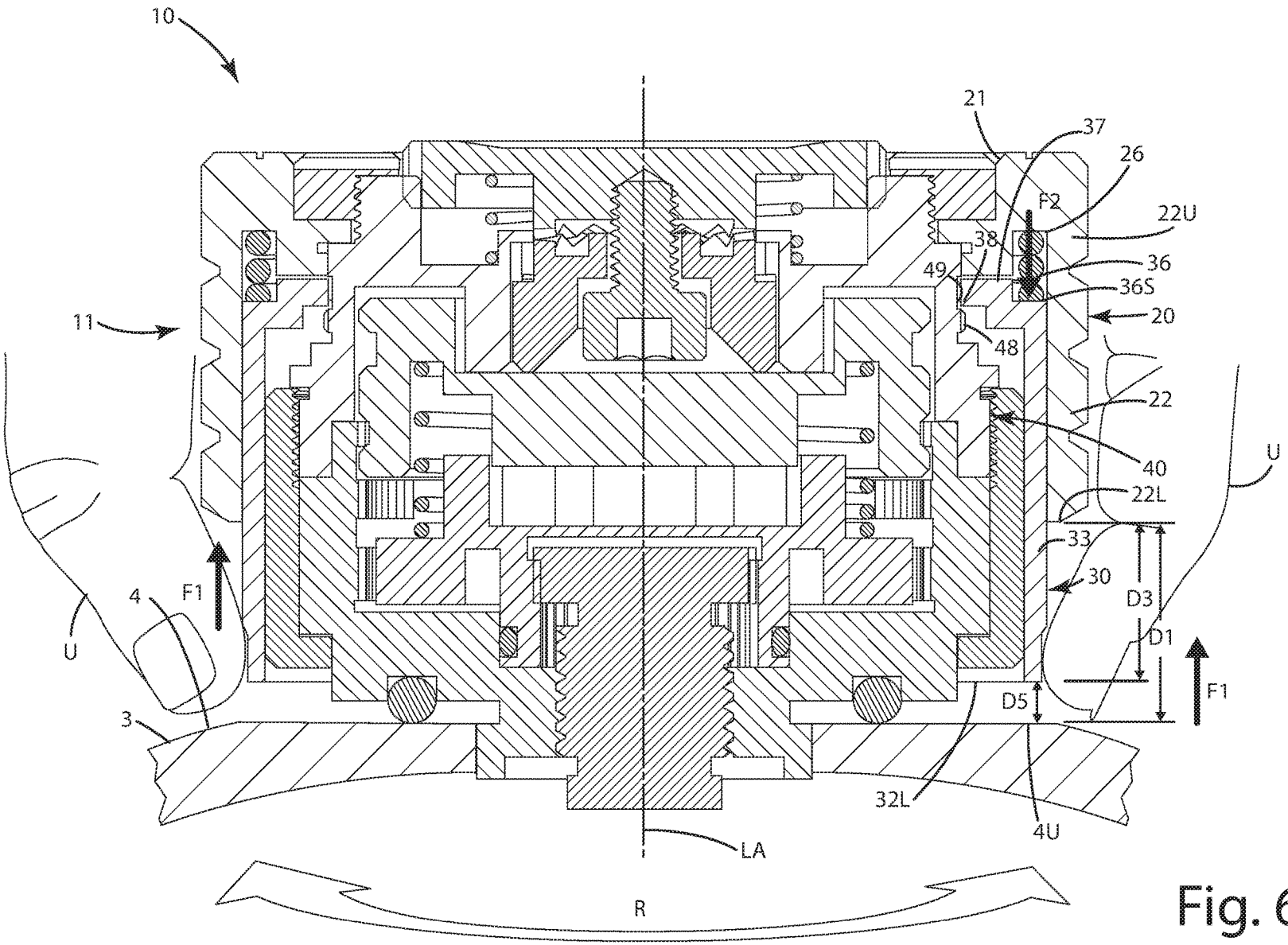
FIG. 6 is a section view of the adjustment turret taken along line IV-IV of FIG. 3, before rezeroing relative to a reference element, where a scale ring of the rezero system is in a second mode to allow movement of the scale ring to rezero about the axis of the turret.

To convert the scale ring 30 and the system 11 to a second mode, a user U, as shown in FIG. 6 can manually engage the scale ring 30 with the user's digits, without the use of any tools. The user can apply force F1, generally parallel to the axis, against the scale ring 30 while grasping the scale ring, but not the dial 20 above it. By applying this force F1, the scale ring 30 moves upward in the interior 23 of the dial 20. As this occurs, the scale ring wall 33 slides relative to the dial wall 22, in particular the exterior 33E of the scale ring wall 33 moves vertically upward relative to the interior of the dial wall 22. The upward force F1 applied by the user also biases the scale ring bias element 36. That spring is compressed and the coils become closer to one another. In so doing, the scale ring 30 continues to move upward. The scale ring 30 can move toward the top 21 of the dial 20. The scale ring 30 can generally move in a vertical motion, generally parallel to the longitudinal axis LA. As it moves upward, the scale teeth 38 slide and move upward vertically upward relative to the holding teeth 48. Eventually, the scale teeth 38 become positioned above the holding teeth 48 so that they no longer engage them. In this location, the scale teeth 38 can be adjacent the toothless area 49. Generally, the holding teeth and scale teeth no longer are engaged with one another.

As a result, the scale ring 30 is no longer rotationally restrained by other components of the turret 10 so the scale ring can be selectively rotated in direction R by the user U. As the scale ring rotates, the associated indicia elements 35 move with the scale ring 30. The user can continue to rotate the scale ring, while it and the system 11 are in the second mode, until a preselected indicia element, for example the alphanumeric "0" and its bar, are aligned with the reference element 39 as shown in FIG. 8. Generally, the indicia elements 35 can be moved about the axis LA when the scale ring 30 is in the second mode so as to align a preselected indicia element with a reference element on the optical device to thereby zero the optical device. Optionally, the scale ring does not rotate relative to the other components until the scale teeth become disengaged from the holding teeth. It will be appreciated here that by zeroing or rezeroing the optical devices, any preselected one or more of the indicia elements can be aligned with one or more reference elements associated with the same component on the optical device, which may or may not be associated with the turret and/or the scope tube, eye bell or other part. Optionally, to zero or rezero, the zero number or indicia need not necessarily be aligned with the reference element.

In the second mode, as mentioned above, the scale ring bias element 36 is biased such that the scale ring can move upward, against the force F2 of the scale ring bias element 36. In this mode, the lower dial edge 22L is also located a second distance D3 from the lower scale ring edge 32L. This second distance D3 can be less than the first distance D2 shown in FIG. 4, when the scale ring is in the first mode. In addition, the scale ring lower edge 32L can be positioned a distance D5 that is greater than a distance D6 from the upper surface 4U of the eye bell 4. In the second mode, the shoulder 30 6S of the scale ring 30 also can be closer to the top 21 of the dial 20 than when the scale ring and rezero system are in the first mode.

Figure 7:
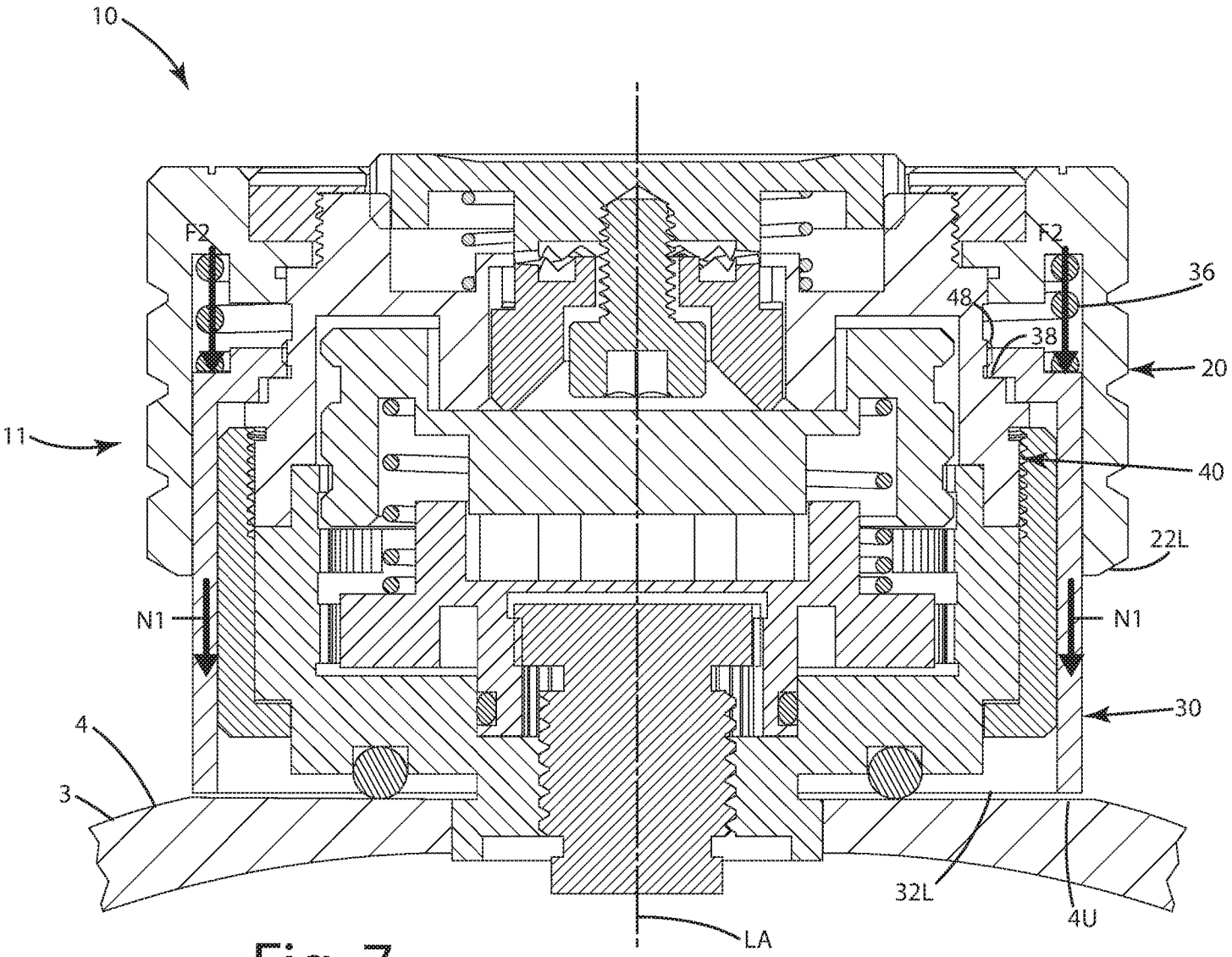
FIG. 7 is a section view of the adjustment turret taken along line IV-IV of FIG. 3, after rezeroing relative to a reference element, where a scale ring of the rezero system is returned to the first mode to fix the scale ring relative to dial and axis of the turret.

After the scale ring has been appropriately moved and rotated to rezero the scale ring, the user U can release the scale ring 30 and generally cease application of the force F1. As a result, the scale ring bias element 36 urges the scale ring 30 downward in direction N as shown in FIG. 7 under the force F2 of the bias element 36. As a result, the scale teeth 38 re-register and become engaged with the holding teeth 48 of the support ring 40. Thus, the scale ring becomes non-rotatable relative to the support ring and generally relative to the dial 20. Referring to FIG. 8, the in this return to the first mode, the scale ring 30 is configured such that the scale on the scale ring is rezeroed. As shown, the number "0" and its associated groove or recess are aligned with the reference element 39. This process noted above can be repeated with the toolless rezero system 11 multiple times, whenever the turret 10 is used to adjust and reset a reticle of the optical device 1.

With reference to FIGS. 1, 9, 10, 11 and 14 the optical device 1 includes the turret 10, with a toolless zero locking system 12. The system 12 can include the adjustment dial 20 which can be manually grasped by a user to rotate portions of the turret 10, a locking cover button 50, an adjusting switch 60, a locking ring 70, a wheelbase 80 and an adjusting pin 6. All of these elements can be disposed about and optionally centered on a longitudinal axis LA of the turret 10.

The toolless zero locking system 12 can be utilized by a user to lock the turret 10 so that the reticle cannot be adjusted with it or moved from a preselected position, either a fixed vertical position or a fixed horizontal position, in the scope tube with that turret or its components. By effectively locking the reticle in a fixed position in a locking mode, also referred to as a first mode, the user can be assured that the point of impact will correspond to the previously set position of the reticle. The reticle is also able to be adjusted in its position relative to the scope tube or other components of the optical device via the turret, when the turret and its locking ring are in an adjustment mode, also referred to as a second mode.

The turret 10 can be configured so that a user can automatically, without the use of tools in a manual operation, convert the turret and its locking ring 70 from the first mode to the second mode and vice versa. As noted above, the optical device 1 can include elevation and windage turrets 10 and 10'. Each of these turrets can be individually and separately configured in a respective locked mode and an adjusting mode. It will be appreciated that the reticle can be joined with a locking ring of one turret in a locked mode, while a locking ring of another turret is in an adjusting mode. For example, the turret 10' and locking ring in the locked mode can hold the reticle in a fixed position with respect to one axis, such as a horizontal axis, while the other turret and locking ring in the adjustment mode can hold the reticle in a fixed position with respect to another axis, for example, a vertical axis.

The various components of the turret 10 will now be described in further detail. Starting with the wheelbase 80, this component can be fixedly and immovably secured to the scope tube 3, and in particular, the eye bell 4 of the scope tube. This securement can be via cement, adhesives, a weld or fasteners securing the wheelbase 80 directly to the surface of the eye bell 4. To prevent moisture or air from entering the eye bell and/or scope, the wheelbase can include a groove that houses and a sealing element 830 which can be in the form of an O-ring or other sealing element. The wheelbase 80 can define a threaded bore 84 within which the adjusting pin 6 is threadably disposed. The adjusting pin 6 also can include a corresponding thread 6T so that upon rotation of the adjusting pin 6 about the axis LA, the adjusting pin 6 moves in directions M. In turn, this can move the reticle 2 relative to the scope tube and/or bell thereby allowing a user to precisely set the reticle relative to a point of impact along an axis. As shown, the direction M can correspond to a vertical axis and the longitudinal axis LA can also correspond to the vertical axis. Accordingly, the turret 10 can be utilized in conjunction with adjusting the elevation of the optical device by moving the reticle up/down. Of course, where the turret is in the form of turret 10', the direction of movement M can align with a horizontal axis and that turret can adjust the windage of the optical device by moving the reticle left/right.

Returning to FIG. 11, as shown there, the turret 10 is in a locking mode. In this locking mode, the wheelbase 80 is fixed relative to the eye bell 4 and scope tube 3. In an adjusting mode, the wheelbase 80 also is fixedly and immovably joined with these components. The wheelbase 80 can include a base wall 81 and an upwardly extending wall 82. The base wall can transition to the upwardly extending wall at a shoulder 82S. As described below, a wheel outer casing 87 can wrap around this shoulder 82S with a flange 87F to secure the locking ring 70, adjustment 20, locking ring cover 50 and other components in a rotatable manner relative to the wheelbase 80, which can be fixed and immovable relative to the eye bell and the scope tube.

The wheelbase 80 can include a wheelbase interior 83. This wheelbase interior 83 can be defined radially inwardly from the upwardly extending base wall 82. Several components can be disposed, inside this wheelbase interior 83. For example, an adjusting base 88 and the locking ring 70 can be disposed at least partially within this interior. The adjusting base 88 can be fixedly and non-rotatably joined with the adjusting pin 6. These two elements can be mated to one another with corresponding teeth on each. The adjusting base 88 and adjusting pin 6 can be joined to rotate in unison about the axis LA. The adjusting base 88 also can be outfitted with a click nail 88N which can intermittently engage the teeth 81 defined by the upwardly extending wall 82. This click nail can divide audible and/or perceivable clicks when the dial 20 is rotated to provide feedback to the user relating to the rotation and adjustment of the reticle.

Figure 11:
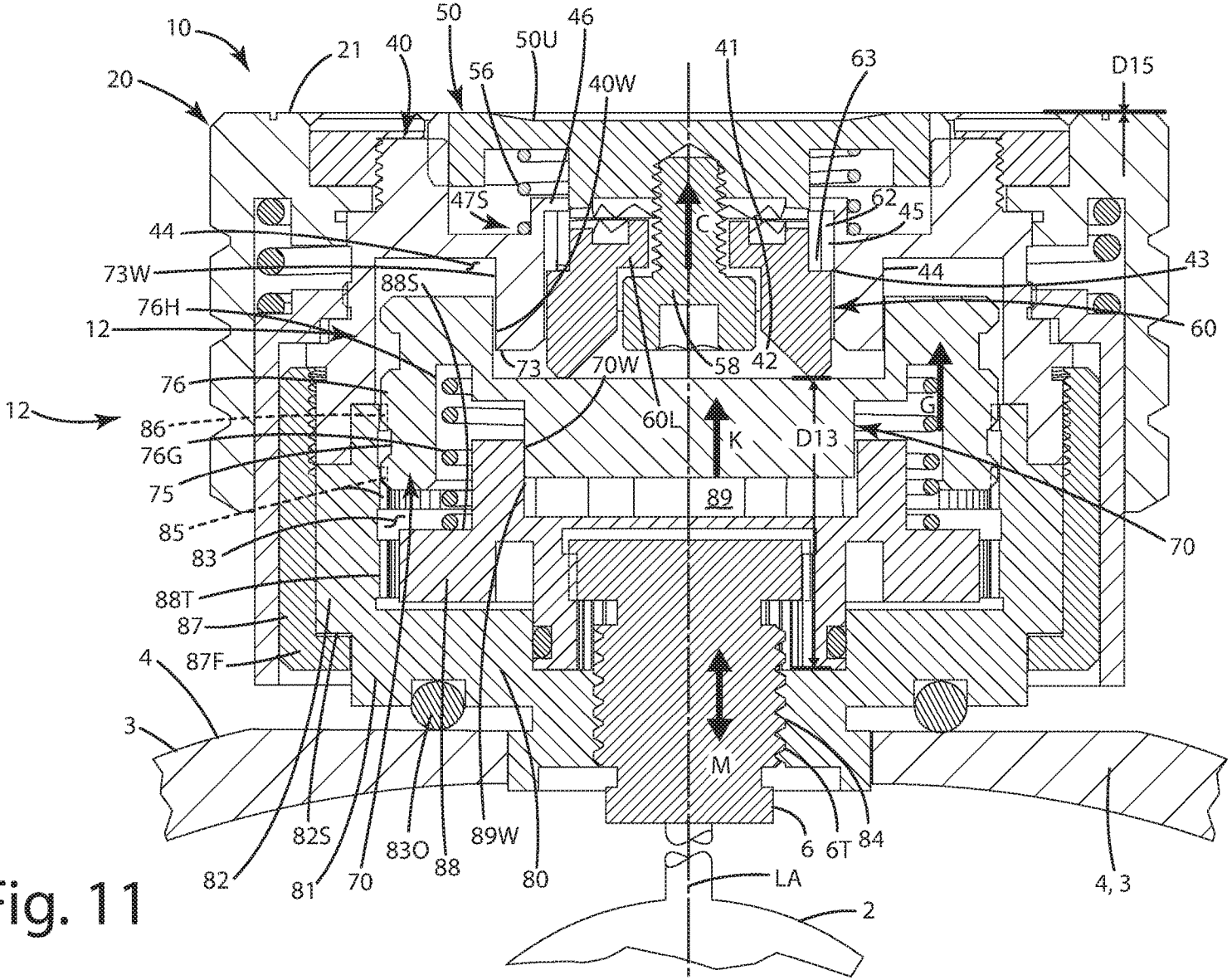
FIG. 11 is a section view of the adjustment turret taken along line IV-IV of FIG. 3, with the zero locking system in a locked mode and a locking ring engaging a wheelbase to prevent rotation of the adjustment dial.

As shown in FIG. 11, the adjusting base 88 also can include a locking ring void 89 defined by an adjustment base wall 89W. This void and the wall can be configured to receive a portion of the locking ring 70. In particular, the locking ring 70 can include a locking ring wall 70W that corresponds in shape and/or configuration or otherwise interlocks within the void and engages the adjustment base wall 89W. With this configuration, the locking ring is selectively movable toward and away from the adjustment base and/or generally the scope tube and/or eye bell, but non-rotatable relative to the adjustment base. Optionally, the locking ring wall 70W and the adjustment base wall 89W can be of identical polygonal shapes so that these elements do not rotate relative to one another. For example, the wall 70W can be in the form of a hexagon and the wall 89W and its corresponding void 89 can also be in the form of a hexagon. These components however can slide relative to one another such that the respective walls of each move and slide relative to one another. This line of movement can be parallel to the longitudinal axis LA.

With reference to FIG. 11, the wheelbase 80 can also include one or more base holding elements 85 and 86. These base holding elements can be in the form of a plurality of base teeth. The base teeth can project inwardly, into the interior 83, of the wheelbase and toward the axis LA of the turret 10. These arrangements of teeth 85 and 86 can be separated vertically from one another by a toothless area 86T is generally void of teeth or projections. Similarly, the locking ring 70 can include one or more ring locking elements 75 and 76 that correspond directly to the one or more base holding elements 85 and 86. These ring locking elements can be in the form of a plurality of ring teeth. These ring teeth can project outwardly, in the interior 83, of the wheelbase, but away from the axis LA of the turret. These ring teeth can be vertically slidable relative to the base teeth to convert the locking ring from the first mode to the second mode as described below.

In the first mode, also referred to as the locking mode shown in FIG. 11, the locking elements 75 and 76 can engage the base holding elements 85 and 86 such that the locking ring 70 is non-rotatable relative to the wheelbase 80, via the interaction of these teeth. Of course, these teeth can be replaced with any other types of projections, recesses or interlocking features. In the second mode, also referred to as the adjusting mode shown in FIG. 14, the ring locking elements 75 and 76 are disengaged from the base holding elements 85 and 86 such that the locking ring 70 is rotatable relative to the wheelbase 80. In this configuration, shown in FIG. 14, the ring teeth 75 can be disposed in the toothless area 86T, while the ring teeth 76 can be disposed vertically above the base teeth 86. Likewise, the ring teeth 75 can be disposed above the base teeth 85. Generally, the ring teeth 75 and 76 are not aligned with any projections or other structure of the wheelbase that impair or prevent rotation of the locking ring 70 relative to the interior of the wheelbase or generally about the axis LA.

Returning to the locked mode shown in FIG. 11, the locking ring 70 is disposed at least partially in the interior 83 of the wheelbase 80. The locking ring, however, also can be disposed in an interior 43 of the locking ring cover 40. The locking ring cover can be threaded or joined with the outer wheel casing 87 to secure those components to the wheelbase 80. The locking ring 70, as well as, the outer casing 87 can be configured to rotate relative to the various features and contours of the wheelbase 80 about the axis when the turret is in the adjusting mode. As shown in FIG. 11, however, the ring teeth are interlocked and engaged with the base teeth so that the locking ring is non-rotatable.

The locking ring 70 can include a locking ring void 73 that is bounded by a secondary locking ring wall 73W. This secondary locking ring wall 73W can be configured to mate with a locking ring cover wall 40W of the locking ring cover 40. These two components can be non-rotatable relative to one another when the walls 40W and 73W interface or engage one another. These walls 40W and 73W can be correspondingly shaped, for example, in the shapes of corresponding polygons, or otherwise can include projections or teeth preventing them from rotating relative to one another. However, these walls can be vertically slidable relative to one another when the turret 10 is converted from a first mode to a second mode or vice versa.

The locking ring 70 can be associated with a locking ring bias element 76G. The locking ring bias element can be disposed on a shoulder 88S of the adjustment base 88. The bias element 76 can be nested in a groove or recess 76H of the locking ring 70. As shown, the locking ring bias element can be in the form of a coil spring. Of course, other types of springs similar to those mentioned above in connection with the scale ring bias element can be used or substituted therefore. The locking ring bias element 76G can be configured to bias the locking ring 70 away from the wheelbase 80 and the adjustment base 88 generally in direction G. In this manner, the locking ring 70 has a tendency to move away from the wheelbase, generally out of the wheelbase interior 83 to interact with the adjusting switch 60 and locking cover button 50 as described below.

As mentioned above, the locking ring 70 is housed in the interior 43 of the locking ring cover 40, also referred to as a support ring. This locking ring cover 40 can include one or more actuator projections 62. These actuator projections 62 can be in the form of columns that extend downwardly adjacent an interior wall 44 of the locking ring cover 40. This wall 43 can be of a generally cylindrical configuration and can define an interior compartment 45 within which the adjusting switch 60 is disposed. The actuator projections can be in the form of three actuator projections or more disposed in this interior compartment 45 to interface with and engage an actuator gear 63 of the adjusting switch 60. These actuator projections or columns 62 can extend partially downward from a roof 46 of the interior compartment 45. These actuator projections, as shown in FIG. 12 can be tapered to optionally include a sloped or slanted face 42S which can engage the actuator gear 63 of the adjusting switch 60.

As shown there, the actuator gear 63, with which the one or more actuator projections 62 can interact, can include a first recess 63R1 defined between teeth of the gear. This first recess 63R1 can be of a first depth D11. The actuator gear can include an adjacent second recess 63R2 defined between other teeth of the gear. This second recess 63R2 can be of a second depth D12. The second depth D12 can be different from the first depth, and as shown, greater than the first depth D11. The interaction of the actuator projection with these respective recesses can dictate movement of the adjusting switch and the locking ring. For example, when the actuator projection 62 engages the first recess 63R1, the adjusting switch is configured to hold the locking ring in the first mode, that is, the locked mode, whereby the reticle cannot be adjusted by the adjustment dial from its vertical position. This is because the locking ring 70 is pushed downward so that the ring teeth 75 and 76 engage the base teeth 85 and 86 so the locking ring or components are not rotatable about the axis. When, however, the actuator projection 62 engages the second recess 63R2, the adjusting switch 60 is configured to hold the locking ring 70 in the second mode such that the reticle 2 can be adjusted via the adjustment dial. In this mode, the locking ring 70 is pushed upward by the spring 76G, and the ring teeth 75 and 76 are no longer engaged with the base teeth 85 and 86 so that the locking ring can rotate relative to the wheelbase 80 along with the other components as described below.

Figure 12:
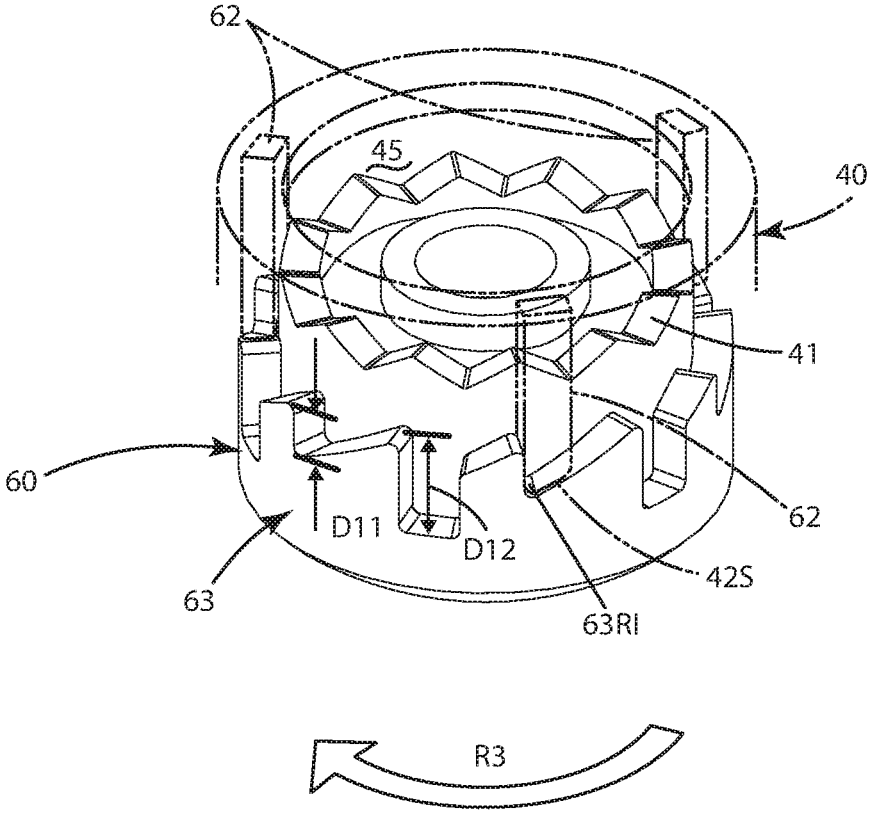
FIG. 12 is a side view of an actuator engaging a recess of an actuator gear of an adjusting switch of the turret in the locked mode.

As shown in FIGS. 11 and 12, the adjusting switch 60 and the locking cover button 50 can include respective gears that are configured to interact with one another and effectively rotate the adjusting switch 60 so that the actuator projection 62 can sequentially engage the actuator gear 63 in the different types of first and second recesses mentioned above. In particular, the top of the adjusting switch 60 can include a first gear 41. The lower portion of the locking cover button 50 can include a second gear 42. These gears can include corresponding arrangements of teeth. These teeth optionally be in a generally triangular shape, with the faces of the teeth angling upward toward a peak from a horizontal line such that those faces are disposed at about optionally 30°. These angles can be selected such that the second gear drives the first gear thereby causing the second gear and its respective teeth to slide and move relative to the teeth of the first gear. In turn, this causes the adjusting switch 60 to rotate about the axis LA. Accordingly, for each instance where the locking cover button is pushed downward toward the wheelbase by a user, the second gear 62 can engage the first gear, and due to the arrangement of the teeth of those gears, the adjusting switch 60 rotates such that the actuator projection 62 engages the gear 63 to move the adjusting switch toward the wheelbase, which in turn moves the locking ring 70 toward the wheelbase 80 to set the locking ring in the first mode. Of course, when the locking cover button is pushed again, the adjusting switch 60 rotates again so that the actuator projection 62 engages a different recess, for example, the deeper recess 63R2. When this occurs, as described further below, the adjusting switch moves from distance D13 in FIG. 11 to distance D14 in FIG. 14. As a result, the locking ring also moves this distance and becomes disengaged with the wheelbase such that the locking ring is thereafter free to rotate about the axis LA in the second mode or adjustment mode shown in FIG. 14 so the reticle can be adjusted from one position to another position as dictated by the particular turret 10.

Figure 13:
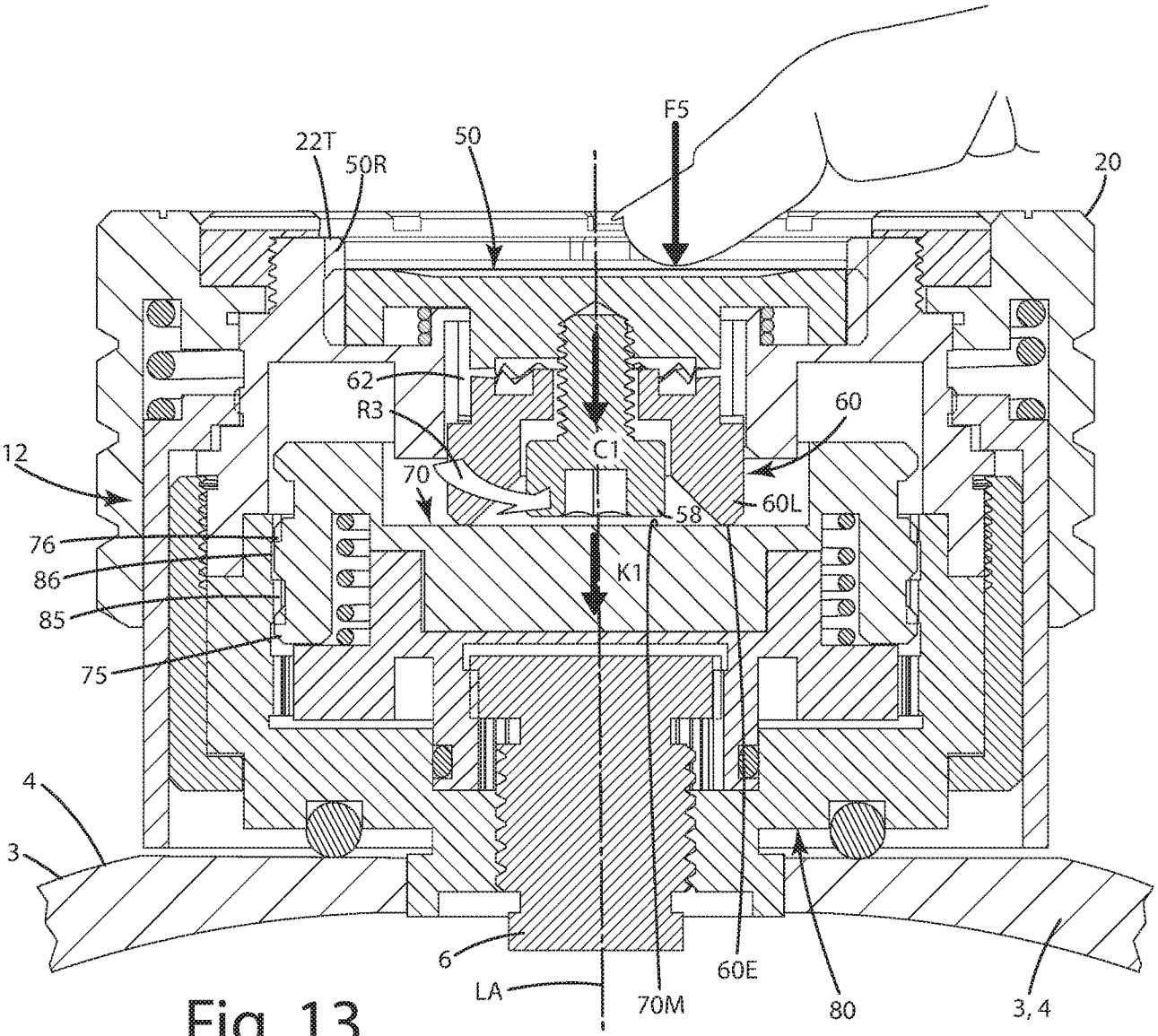
FIG. 13 is a section view of the adjustment turret taken along line IV-IV of FIG. 3, with the zero locking system about to transition from the locked mode to an adjusting mode, with the locking cover button being depressed to engage the adjusting switch against the locking ring.

Optionally, as shown in FIG. 13, the adjusting switch 60 includes a lower portion 60L. This lower portion 60L can taper to a lower engagement edge 60E that is of a small surface area. This edge can be circular. This edge 60E can rotate relative to the engagement surface 70M of the ring 70, and thereby provide a sliding interaction between the edge 60F and the surface 70M. The edge can slide in a circular path along the surface.

Returning to FIG. 11, the locking cover button 50 can include the second adjusting gear 62 on its bottom surface. The locking cover button can be engaged by a button base element 56 which as shown can be in the form a base coil spring. Of course, other types of bias elements described herein can be substituted for the coil spring. The coil spring engages against and under the surface of the locking cover button 50 as well as a shelf 47S of the locking ring cover 40. The spring 56 biases the locking cover button away from the wheelbase, and can circumferentiate the axis LA.

The locking cover button 50 can be non-rotatably mounted relative to the dial 20. In particular, as shown in FIGS. 1 and 13, the locking button 50 can include one or more recesses 50R. The dial 20 can include one or more teeth 22T that fit within those recesses 50R. The interaction of the teeth in the recesses can prevent the locking cover button 50 from rotating relative to the dial 20. However, the interaction of these components still allows the button to move vertically along a line of measurement parallel to the longitudinal axis LA, for example, up and down or in and out relative to the wheelbase 80.

The locking button cover 50 can be joined with a plunger 58, which as shown is in the form of a fastener that is threaded into the lower portion of the locking cover button 50. This plunger can engage in undersurface 60L of the adjusting switch 62 effectively pulling that adjusting switch upward, in direction C optionally under the expanding force provided by the bias element 56. In turn, the bias force G of the bias element 76G pushes the locking ring upward in direction K as described further below.

As illustrated in FIG. 11, the locking cover button can include an upper surface 50U. This upper surface 50U can be disposed adjacent a top 20T of the adjustment dial 20. In the first mode, where the locking ring and turret are locked so that the dial 20 cannot rotate to adjust the adjusting pin and reticle, the upper surface 50U can be disposed a first distance above the top surface 20T of the dial. This first distance D15 can optionally can be zero such that the upper surface is flush with the top surface. In other cases, the first distance can be greater than zero, optionally at least 1 mm, at least 2 mm, at least 3 mm or at least 5 mm or other distances. However, when the turret and locking ring are in the second mode, so that the dial can rotate to adjust the adjusting pin, the upper surface 50U can be disposed a second distance D16, from the top surface shown in FIG. 14. This second distance D16 can be greater than the first distance D15. That is, the upper surface 50U can be spaced above and higher than the top 20T of the dial 20, and can be no longer flush therewith. Optionally, in some cases, such as when the locking cover button 50 is transitioning from the first mode shown in FIG. 11 to the second mode shown in FIG. 14, the upper surface 50U can optionally be disposed below the top surface 20T as shown in FIG. 13.

Figure 14:
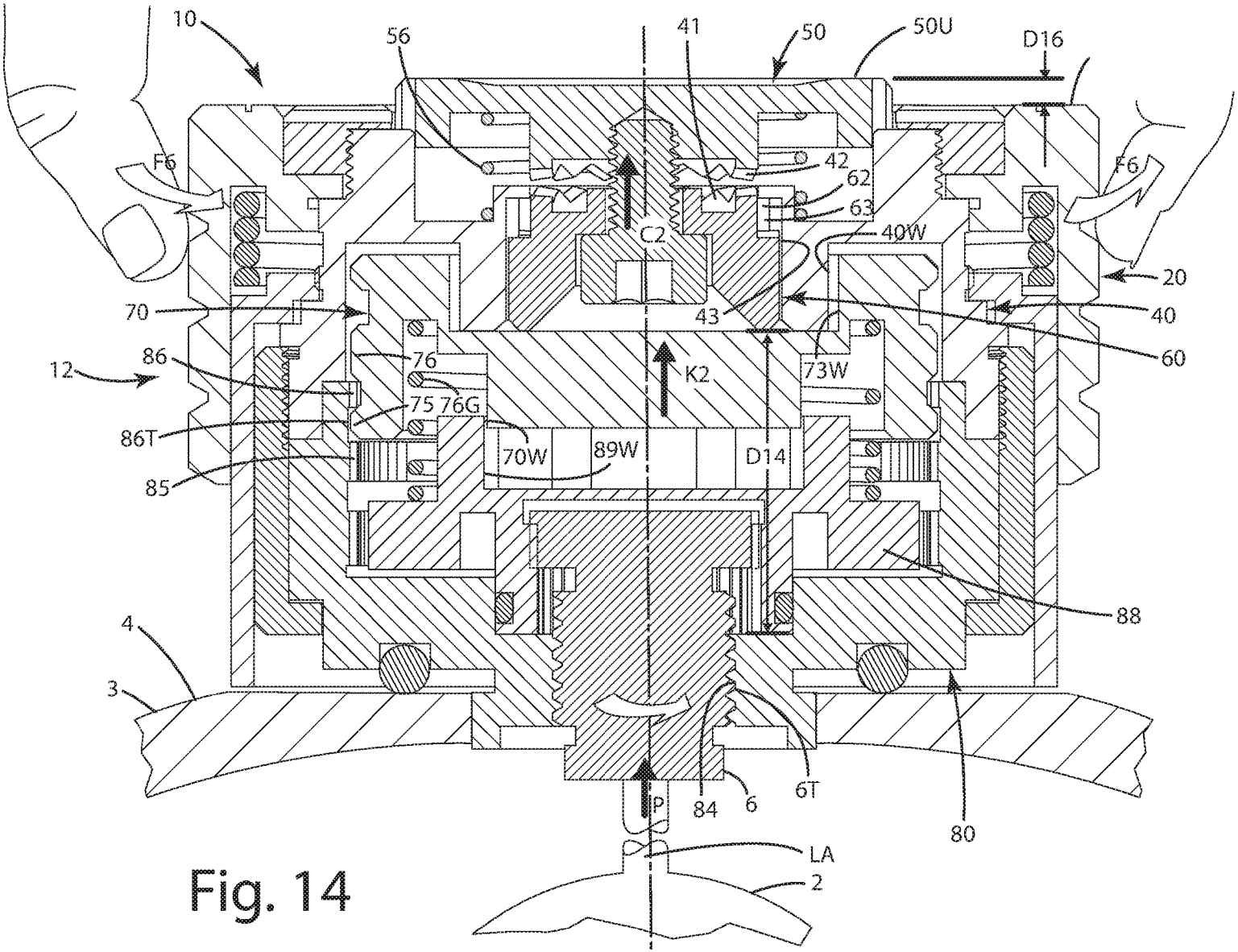
FIG. 14 is a section view of the adjustment turret taken along line IV-IV of FIG. 3, with the zero locking system in an adjusting mode and a locking ring disengaged from the wheelbase so that the adjustment dial can be rotated in that rotation can translate to an adjusting pin to move the reticle.

Operation of the zero locking system 12 will now be described with reference to FIGS. 11-14. Shown there is a method of locking an optical device such as the scope 1 such that the reticle 2 associated with the turret 10 cannot be moved after such locking. That method can generally include providing the adjustment dial 20 and the locking ring cover 50; moving the locking cover button 50 a first time, manually without the use of tools, for example, by pressing down on the button 50 with a force F5 as shown in FIG. 13, to automatically convert the locking ring from the first mode in which the locking ring is non-rotatable relative to the axis LA, to a second mode, that is, an adjusting mode, in which the locking ring 40 is rotatable relative to the axis LA; rotating the adjustment dial 20 and the locking ring 70 in unison, for example, under a rotating force F6 provided by a user manually, as shown in FIG. 14. Optionally, the user can move the locking cover button 50 a second time by pushing down on the cover button 50 as shown in FIG. 14, manually without the use of tools, to automatically convert the locking ring from the second mode to the first mode, shown in FIG. 11, such that the locking ring 70 is again non-rotatable relative the axis LA and such that the adjustment dial cannot be rotated to move the reticle 2 relative to the scope tube and its components.

More particularly, and shown by comparing FIGS. 11 and 13, where the turret and locking ring are being converted from the first mode to the second mode, the user can press down with a force F5 on the button 50. As a result, the second gear 42 of the button 50 engages the first gear 41 of the adjusting switch 60. This causes the adjusting switch to rotate in direction R3 shown in FIG. 12. As a result, the actuator projection 62 shown in FIG. 12 moves from the first recess 63R1 to the second recess 63R2. Pressing down on the button 50 also moves the adjusting switch 60 so that it engages the locking ring 70 moving it downward in direction K 1. The springs 56 and 76G also are compressed during and under this force. The locking ring 70, adjusting switch 60 and button 50 therefore all move toward the wheelbase 80. In so doing, the ring teeth 75, 76 also move downward relative to the wheelbase teeth 85 and 86. Optionally, the teeth 75 remain engaged with the teeth 85 during this downward movement.

Figure 15:
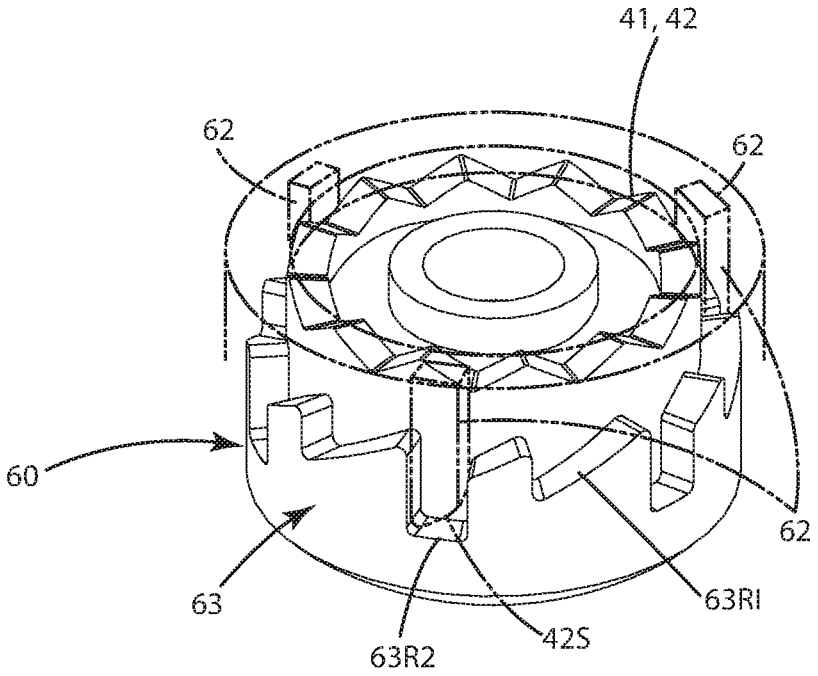
FIG. 15 is a side view of the actuator engaging another deeper recess of the actuator gear of the adjusting switch of the turret in the adjusting mode.

When the force F5 is removed, after the system bottoms out as shown in FIG. 13, the adjuster switch 60 has rotated due to the interaction of the first gear 41 and second gear 42. As a result, when the actuator gear 63 moves back upward, under the force of the springs 76G and 56 in direction C2, the actuator projections 62 engage the deeper recess 63R2 of that gear 63 as shown in FIG. 15. Accordingly, the adjuster adjusting switch 60 is allowed to travel farther upward and away from the wheelbase as shown in FIG. 14 in direction C2. Likewise, the locking ring 70 is also allowed to travel farther upward in direction K2 relative to the longitudinal axis LA. Accordingly, from the locked mode shown in FIG. 11 to the adjusting mode shown in FIG. 14, the adjusting switch 60 moves from a distance D13 to a distance D14 away from the wheelbase 80 as shown. The distance D14 is greater than the distance D13. Optionally, during this movement, the cover button 50 also moves above the top 20T of the adjusting dial 20. The locking ring 70 also moves upward in direction K2, away from the adjusting base 88, but still remains engaged with the wall 89W of the adjusting base via the wall 70W. In this manner, the locking ring vertically slides upward in a direction parallel to the axis LA. The locking ring and adjusting base remain nonrotatingly secured to one another, but together, can rotate about the axis LA.

In addition, as shown in FIG. 14, the ring teeth 75 and 76 become disengaged from the base teeth 85 and 86. The ring teeth 75 are disposed in a toothless region 86T between the base teeth 85 and 86. The teeth ring teeth 76 are disposed above the upper base teeth 86. Generally, these teeth 75 and 76 no longer have any structure to interface with, so that they can freely move relative to the wall, within the interior 83, of the wheelbase 80.

As further shown in FIG. 14, the locking ring bias element 76G pushes upward on locking ring to assist in its upward movement K2 away from the wheelbase. The button cover bias element 56 also pushes upward on the button cover 50 to move it upward in direction C2 and away from the wheelbase 80. As mentioned above, the first gear 41 also can become disengaged from the second gear 42 on the bottom of the button 50. In so doing, the respective teeth of these gears can be slightly misaligned due to the rotation of the adjusting switch 60 via the actuator gear actuator projection 62 engaging the actuator gear 63 such that the next time the button 50 is moved downward, the first 41 and second 42 gears engage one another, to again cause rotation in direction R3 (FIG. 12) and translate the components such that the locking ring and turret again attain the first mode.

As shown in FIG. 14, the zero locking system 12 is in the second mode, or adjustment mode. In this mode, the dial 20 can be rotated under rotational force F6 extended by the user. The dial thus rotates in the direction of F6. The button cover 50 also rotates in this direction. The locking ring cover 40, which is fixed in non-rotatable relative to the dial also rotates. The locking ring 70 which again is free from interlocking with the wheelbase 80 also rotates because the ring teeth and base teeth are disengaged from one another. The locking ring 70 however is rotationally locked to the locking ring cover via the interface of the wall 40W with the wall 73W. The locking ring 70 is further rotationally locked relative to the adjusting base 88 via the interfacing of the locking ring wall 70W with the adjusting base wall 89W. Thus, all of these elements can rotate in unison.

In addition, the adjusting base 88 is non-rotatably joined with the adjusting pin 60. Thus, the adjusting pin 6 also rotates in unison with the other elements. As a result of the rotation in the direction of the force F6, the adjusting pin 6 also rotates. Due to the adjusting pin threads 6T interacting with the threads 84 of the wheelbase, the pin advances in direction P. As a result, the reticle 2 also moves in direction P to move the reticle relative scope tube 3. This in turn, allows the user to adjust point of impact of crosshairs 2C of the reticle 2. Of course, the force F6 can be reversed in opposite direction to reverse the direction of movement of the pin 6 in a direction opposite that of direction P. The pin 6 can be rotated clockwise or counterclockwise to move the reticle 2 within the scope tube, up or down, or side to side depending on which turret is involved.

After satisfactory adjustment of the reticle 2 is accomplished, the user can again press down on the cover button 50 which in turn rotates the adjusting switch 60, thereby moving the locking ring in a direction opposite the direction K2 shown in FIG. 14. This in turn locks the teeth of the locking ring with teeth of the base. Again, these teeth can become engaged with one another, sliding vertically along a line of movement is generally parallel to the axis LA. With the locking of the locking ring 70 relative to the wheelbase 80. The dial 20 is also locked in place and cannot be rotated due to the connection of the locking ring to the wheelbase. Thus, the reticle 2 cannot be moved relative to the scope, tube or other components of the optical device in the direction for which the turret is designed to move, for example up/down or left/right.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An apparatus configured to adjust a turret associated with a reticle of an optical device, the apparatus comprising:

an adjustment dial configured to be grasped by a user to adjust a reticle of an optical device, the adjustment dial rotatable about an axis, the adjustment dial including a top and a downwardly extending dial wall, the dial wall bounding a dial interior;

a wheelbase configured to be fixedly and immovably joined with a scope tube element;

an adjusting pin rotatably disposed in the wheelbase and configured to be joined with a reticle for relative movement of the reticle;

a locking ring disposed adjacent the adjustment dial, the locking ring being operable in a first mode in which the locking ring rotatably couples the adjustment dial with the adjusting pin such that rotation of the adjustment dial translates to movement of the reticle, and a second mode in which the locking ring couples the adjustment dial to the wheelbase such that the adjustment dial is non-rotatable relative to the wheelbase such that rotation of the adjustment dial does not translate to movement of the reticle, while the adjustment dial remains connected to the wheelbase; and a locking cover button selectively manually movable, without the use of tools, to convert the locking ring from the first mode to the second mode, whereby movement of the locking cover button translates the locking ring from the first mode in which a position of the reticle can be changed, to the second mode in which the position of the reticle is locked.

2. An apparatus configured to adjust a turret associated with a reticle of an optical device, the apparatus comprising:

an adjustment dial configured to be grasped by a user to adjust a reticle of an optical device, the adjustment dial rotatable about an axis, the adjustment dial including a top and a downwardly extending dial wall, the dial wall bounding a dial interior;

a wheelbase configured to be fixedly and immovably joined with a scope tube element;

an adjusting pin rotatably disposed in the wheelbase and configured to be joined with a reticle for relative movement of the reticle;

a locking ring disposed adjacent the adjustment dial, the locking ring being operable in a first mode in which the locking ring rotatably couples the adjustment dial with the adjusting pin such that rotation of the adjustment dial translates to movement of the reticle, and a second mode in which the locking ring couples the adjustment dial to the wheelbase such that the adjustment dial is non-rotatable relative to the wheelbase such that rotation of the adjustment dial does not translate to movement of the reticle; and a locking cover button selectively manually movable, without the use of tools, to convert the locking ring from the first mode to the second mode, whereby movement of the locking cover button translates the locking ring from the first mode in which a position of the reticle can be changed, to a second mode in which the position of the reticle is locked, wherein the locking cover button is disposed adjacent a top of the adjustment dial, wherein the locking cover button includes an upper surface, wherein the locking cover button upper surface is a first distance above the top surface of the adjustment dial when the locking ring is in the first mode, wherein the locking cover button upper surface is a second distance above the top surface of the adjustment dial when the locking ring is in the second mode, wherein the second distance is greater than the first distance.

3. The apparatus of claim 2, wherein the first distance is zero such that the locking cover button upper surface is flush with the top surface.

4. The apparatus of claim 3, comprising:

an adjusting switch disposed below the locking cover button and above the wheelbase, wherein the adjusting switch includes a first adjusting gear, wherein the locking cover button includes a second adjusting gear, wherein the first adjusting gear is configured to engage the second adjusting gear so as to impart rotation to the adjusting switch about the axis when the second adjusting gear engages the first adjusting gear.

5. An apparatus configured to adjust a turret associated with a reticle of an optical device, the apparatus comprising:

an adjustment dial configured to be grasped by a user to adjust a reticle of an optical device, the adjustment dial rotatable about an axis, the adjustment dial including a top and a downwardly extending dial wall, the dial wall bounding a dial interior;

a wheelbase configured to be fixedly and immovably joined with a scope tube element;

an adjusting pin rotatably disposed in the wheelbase and configured to be joined with a reticle for relative movement of the reticle;

a locking ring disposed adjacent the adjustment dial, the locking ring being operable in a first mode in which the locking ring rotatably couples the adjustment dial with the adjusting pin such that rotation of the adjustment dial translates to movement of the reticle, and a second mode in which the locking ring couples the adjustment dial to the wheelbase such that the adjustment dial is non-rotatable relative to the wheelbase such that rotation of the adjustment dial does not translate to movement of the reticle; and a locking cover button selectively manually movable, without the use of tools, to convert the locking ring from the first mode to the second mode, whereby movement of the locking cover button translates the locking ring from the first mode in which a position of the reticle can be changed, to a second mode in which the position of the reticle is locked, an adjusting switch disposed between the locking cover button and the locking ring;

wherein the adjusting switch includes an actuator gear, the actuator gear including a first recess of a first depth and a second recess of a second depth, different from the first depth, wherein the locking ring cover includes an actuator projection, wherein when the actuator projection engages the first recess, the adjusting switch is configured to hold the locking ring in the first mode whereby the reticle cannot be adjusted by the adjustment dial, wherein when the actuator projection engages the second recess, the adjusting switch is configured to hold the locking ring in the second mode whereby the reticle can be adjusted via the adjustment dial.

6. The apparatus of claim 5, wherein the second depth is greater than the first depth, wherein a lower portion of the adjusting switch tapers to an engagement edge, wherein the engagement edge rotates relative to an engagement surface of the locking ring and provides a sliding interaction between the engagement edge and the engagement surface.

7. The apparatus of claim 1, wherein the wheelbase includes at least one base holding element, wherein the locking ring includes at least one ring locking element, wherein in the first mode, the at least one ring locking element engages the at least one base holding element such that the locking ring is non-rotatable relative to the wheelbase, wherein in the second mode, the at least one ring element is disengaged from the at least one base holding element such that the locking ring is rotatable relative to the wheelbase.

8. The apparatus of claim 7, wherein the at least one base holding element is a plurality of base teeth, wherein the at least one ring locking element is a plurality of ring teeth, wherein the ring teeth are vertically slidable relative to the base teeth to convert the locking ring from the first mode to the second mode.

9. An apparatus configured to adjust a turret associated with a reticle of an optical device, the apparatus comprising:

an adjustment dial configured to be grasped by a user to adjust a reticle of an optical device, the adjustment dial rotatable about an axis, the adjustment dial including a top and a downwardly extending dial wall, the dial wall bounding a dial interior;

a wheelbase configured to be fixedly and immovably joined with a scope tube element;

an adjusting pin rotatably disposed in the wheelbase and configured to be joined with a reticle for relative movement of the reticle;

a locking ring disposed adjacent the adjustment dial, the locking ring being operable in a first mode in which the locking ring rotatably couples the adjustment dial with the adjusting pin such that rotation of the adjustment dial translates to movement of the reticle, and a second mode in which the locking ring couples the adjustment dial to the wheelbase such that the adjustment dial is non-rotatable relative to the wheelbase such that rotation of the adjustment dial does not translate to movement of the reticle; and a locking cover button selectively manually movable, without the use of tools, to convert the locking ring from the first mode to the second mode, whereby movement of the locking cover button translates the locking ring from the first mode in which a position of the reticle can be changed, to a second mode in which the position of the reticle is locked, an adjustment base coupled to the adjusting pin such that the adjusting pin and adjusting base rotate in unison, the adjustment base including an adjustment base wall, wherein the locking ring includes a locking ring wall, wherein the locking ring wall engages the adjustment base wall such that the locking ring is selectively movable toward and away from the adjustment base but non-rotatable relative to the adjustment base.

10. The apparatus of claim 1, comprising:

a locking ring bias element engaged against the locking ring and configured to bias the locking ring away from the wheelbase.

11. An apparatus configured to adjust a turret associated with a reticle of an optical device, the apparatus comprising:

an adjustment dial configured to be grasped by a user to adjust a reticle of an optical device, the adjustment dial rotatable about an axis, a wheelbase configured to be fixedly and immovably joined with a scope tube element;

an adjusting pin adjacent the wheelbase and rotatable about the axis, the adjusting pin configured to be joined with a reticle for relative movement of the reticle;

a locking ring disposed between the adjustment dial and the adjusting pin, the locking ring being operable in a first mode in which the locking ring rotatably couples the adjustment dial with the adjusting pin such that rotation of the adjustment dial translates to movement of the reticle, and a second mode in which the locking ring couples the adjustment dial to the wheelbase such that the adjustment dial is non-rotatable relative to the wheelbase such that rotation of the adjustment dial does not translate to movement of the reticle while the adjustment dial remains connected to the wheelbase; and a locking cover button selectively manually movable, without the use of tools, to convert the locking ring from the first mode to the second mode, whereby movement of the locking cover button translates the locking ring from the first mode in which a position of the reticle can be changed, to a second mode in which the position of the reticle is locked by the locking ring.

12. An apparatus configured to adjust a turret associated with a reticle of an optical device, the apparatus comprising:

an adjustment dial configured to be grasped by a user to adjust a reticle of an optical device, the adjustment dial rotatable about an axis, a wheelbase configured to be fixedly and immovably joined with a scope tube element;

an adjusting pin adjacent the wheelbase and rotatable about the axis, the adjusting pin configured to be joined with a reticle for relative movement of the reticle;

a locking ring disposed between the adjustment dial and the adjusting pin, the locking ring being operable in a first mode in which the locking ring rotatably couples the adjustment dial with the adjusting pin such that rotation of the adjustment dial translates to movement of the reticle, and a second mode in which the locking ring couples the adjustment dial to the wheelbase such that the adjustment dial is non-rotatable relative to the wheelbase such that rotation of the adjustment dial does not translate to movement of the reticle; and a locking cover button selectively manually movable, without the use of tools, to convert the locking ring from the first mode to the second mode, whereby movement of the locking cover button translates the locking ring from the first mode in which a position of the reticle can be changed, to a second mode in which the position of the reticle is locked by the locking ring, wherein the locking ring includes a first plurality of locking teeth, wherein the first plurality of locking teeth are movable relative to a second plurality of locking teeth along a line of movement that is parallel to the axis;

wherein the first plurality of teeth are configured to interlock with the second plurality of locking teeth such that the locking ring is non-rotatable relative to the wheelbase in the first mode.

13. An apparatus configured to adjust a turret associated with a reticle of an optical device, the apparatus comprising:

an adjustment dial configured to be grasped by a user to adjust a reticle of an optical device, the adjustment dial rotatable about an axis, a wheelbase configured to be fixedly and immovably joined with a scope tube element;

an adjusting pin adjacent the wheelbase and rotatable about the axis, the adjusting pin configured to be joined with a reticle for relative movement of the reticle;

a locking ring disposed between the adjustment dial and the adjusting pin, the locking ring being operable in a first mode in which the locking ring rotatably couples the adjustment dial with the adjusting pin such that rotation of the adjustment dial translates to movement of the reticle, and a second mode in which the locking ring couples the adjustment dial to the wheelbase such that the adjustment dial is non-rotatable relative to the wheelbase such that rotation of the adjustment dial does not translate to movement of the reticle; and a locking cover button selectively manually movable, without the use of tools, to convert the locking ring from the first mode to the second mode, whereby movement of the locking cover button translates the locking ring from the first mode in which a position of the reticle can be changed, to a second mode in which the position of the reticle is locked by the locking ring, an adjusting switch disposed between the locking cover button and the locking ring, wherein the adjusting switch is rotatable relative to the locking ring, wherein the adjusting switch is configured to move at least one of toward and away from the wheelbase in transitioning from the first mode to the second mode.

14. The apparatus of claim 13, wherein the locking ring cover includes a first gear, wherein the adjusting switch includes a second gear, wherein the first gear interfaces with the second gear thereby causing the adjusting switch to rotate about the axis, wherein the adjusting switch moves the locking ring at least one of toward and away from the wheelbase when the adjusting switch rotates about the axis.

15. An apparatus configured to adjust a turret associated with a reticle of an optical device, the apparatus comprising:

an adjustment dial configured to be grasped by a user to adjust a reticle of an optical device, the adjustment dial rotatable about an axis, a wheelbase configured to be fixedly and immovably joined with a scope tube element;

an adjusting pin adjacent the wheelbase and rotatable about the axis, the adjusting pin configured to be joined with a reticle for relative movement of the reticle;

a locking ring disposed between the adjustment dial and the adjusting pin, the locking ring being operable in a first mode in which the locking ring rotatably couples the adjustment dial with the adjusting pin such that rotation of the adjustment dial translates to movement of the reticle, and a second mode in which the locking ring couples the adjustment dial to the wheelbase such that the adjustment dial is non-rotatable relative to the wheelbase such that rotation of the adjustment dial does not translate to movement of the reticle; and a locking cover button selectively manually movable, without the use of tools, to convert the locking ring from the first mode to the second mode, whereby movement of the locking cover button translates the locking ring from the first mode in which a position of the reticle can be changed, to a second mode in which the position of the reticle is locked by the locking ring, wherein the locking cover button rotates relative to the wheelbase when the locking ring is in the second mode, wherein the locking cover button is rotatably fixed relative to the adjustment dial when the locking ring is in the second mode, wherein the adjusting pin rotates relative to the wheelbase when the locking ring is in the second mode.

16. The apparatus of claim 11, comprising:

an adjusting switch that is rotatable relative to the locking ring, the adjusting switch configured to move toward the wheel base when the locking ring transitions to the second mode in which the position of the reticle is locked by the locking ring.

17. A method of locking an optical device comprising:

providing an adjustment dial configured to be grasped by a user to adjust an optical device, and a locking cover button;

moving the locking cover button a first time, manually without the use of tools, to automatically convert a locking ring from a first mode in which the locking ring is non-rotatable relative to an axis to a second mode in which the locking ring is rotatable relative to the axis;

rotating the adjustment dial and the locking ring in unison about the axis to move a reticle relative to a scope tube; and moving the locking cover button a second time, manually without the use of tools, to automatically convert the locking ring from the second mode to the first mode, such that the locking ring is non-rotatable relative to the axis, and such that the adjustment dial cannot be rotated to move the reticle relative to the scope tube, wherein the adjustment dial remains connected to a wheelbase in the first mode and in the second mode.

18. A method of locking an optical device comprising:

providing an adjustment dial configured to be grasped by a user to adjust an optical device, and a locking cover button;

moving the locking cover button a first time, manually without the use of tools, to automatically convert a locking ring from a first mode in which the locking ring is non-rotatable relative to an axis to a second mode in which the locking ring is rotatable relative to the axis;

rotating the adjustment dial and the locking ring in unison about the axis to move a reticle relative to a scope tube; and moving the locking cover button a second time, manually without the use of tools, to automatically convert the locking ring from the second mode to the first mode, such that the locking ring is non-rotatable relative to the axis, and such that the adjustment dial cannot be rotated to move the reticle relative to the scope tube, wherein during the moving the locking cover button a first time, the locking cover button interfaces with an adjusting switch to disengage a locking element of the locking ring from a base holding element such that the locking ring is free to rotate relative to a wheelbase.

19. The method of claim 18, wherein during the moving the locking cover button a first time, the locking cover button moves away from the wheelbase.

20. The method of claim 17, wherein the moving the locking cover button a second time causes the locking ring to move along the axis toward a wheelbase.

* * * * *